US011189259B2

(12) United States Patent
Tzanetos

(10) Patent No.: US 11,189,259 B2
(45) Date of Patent: Nov. 30, 2021

(54) ACTIVE NOISE CANCELLATION FOR DEFINED SPACES

(71) Applicant: Theodore Tzanetos, Plainview, NY (US)

(72) Inventor: Theodore Tzanetos, Plainview, NY (US)

( * ) Notice: Subject to any disclaimer, the term of this patent is extended or adjusted under 35 U.S.C. 154(b) by 0 days.

(21) Appl. No.: 16/896,205

(22) Filed: Jun. 8, 2020

(65) Prior Publication Data

US 2020/0302907 A1 Sep. 24, 2020

Related U.S. Application Data

(60) Continuation of application No. 16/358,472, filed on Mar. 19, 2019, now Pat. No. 10,685,639, which is a division of application No. 15/663,589, filed on Jul. 28, 2017, now abandoned.

(60) Provisional application No. 62/367,849, filed on Jul. 28, 2016.

(51) Int. Cl.
*G10K 11/175* (2006.01)
*G10K 11/178* (2006.01)

(52) U.S. Cl.
CPC ..... *G10K 11/175* (2013.01); *G10K 11/17857* (2018.01); *G10K 11/17881* (2018.01); *G10K 2210/12* (2013.01); *G10K 2210/3028* (2013.01)

(58) Field of Classification Search
None
See application file for complete search history.

(56) References Cited

U.S. PATENT DOCUMENTS

2012/0237049 A1* 9/2012 Brown ..... G10K 11/17873 381/71.1
2015/0055790 A1* 2/2015 Kawakami ..... G10K 11/17857 381/73.1
2017/0110105 A1* 4/2017 Kumar ..... G10K 11/17881

* cited by examiner

*Primary Examiner* — Kenny H Truong
(74) *Attorney, Agent, or Firm* — Dergosits & Noah LLP

(57) ABSTRACT

Systems and methods are provided for generating destructive interference signals for use in active noise cancellation in an interior setting of an urban environment. The system employs a combination of conventional ANC and predictive state estimation to generate destruction interference sound waves using a window pane to counteract urban noises.

9 Claims, 18 Drawing Sheets

ACTIVE NOISE CANCELLATION FOR DEFINED SPACES

CLAIM OF PRIORITY

This application is a continuation of U.S. patent application Ser. No. 16/358,472, entitled "Active Noise Cancellation for Defined Spaces," filed, Mar. 19, 2019, which is a divisional application of U.S. patent application Ser. No. 15/663,589, entitled "Active Noise Cancellation for Defined Spaces," filed Jul. 28, 2017, which claims the benefit of U.S. Provisional Patent Application 62/367,849 entitled "Active Noise Cancellation for Urban Interiors," filed Jul. 28, 2016, the entire contents of which are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

One or more implementations relate generally to active noise cancellation system for defined spaces.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Active noise cancellation (ANC) technology attempts to generate destructive interference sound waves to cancel out unwanted noise. ANC has been applied to numerous technologies such as headphones, communications systems, mechanical stability systems, heating ventilation and air conditioning (HVAC) systems and others with varying degrees of success. Recently, the concept of window mounted ANC devices which are tunable and which would provide a user the ability to selectivity eliminates outside noises have entered the market. Such window mounted ANC devices may use the windowpane as a speaker surface. For example, conceptually, a window mounted ANC may cause a window to vibrate in a pattern counter to the vibrations caused by the ambient noise, essentially turning the surface into a noise-canceling speaker. However, current window mounted ANC devices unsuccessfully attempt to use window vibrations to counter act vibrations made from static noise signals. Static noise signals refer to slowly changing and slowing evolving noise signals in reference to time. That is, the tones of the noises do not change quickly, but instead, maintain a steady frequency. For example, the hum of an air conditioning system, airplane engines flying overhead, or the noise generated from a loud server room are all examples of noises that are static.

Additionally, such window mounted ANC and other surface mounted ANC systems are unable to provide noise cancellation of dynamic noise signals. Dynamic noise signals are quickly varying, not auto-correlated, and/or non-periodic noise signals in time. Examples of dynamic noise signals include horns, sirens, dogs barking, people yelling, roosters crowing, and the like. Current ANC products are unable to provide cancellation of dynamic noise signals because dynamic noise signals are hard to track and/or to predict.

It would thus be advantageous to create an indoor ANC system that accounts for signals with dynamic frequency content. It would be advantageous to create such a system that employs transducer mounted to a surface that is capable of coupling noise. For example, the transducer may be mounted to windowpanes or walls capable of coupling noise. It would further be advantageous to provide such an ANC system that combines existing ANC technology with predictive techniques.

SUMMARY OF INVENTION

Many advantages will be determined and are attained by the disclosed technology, which in a broad sense provides ANC systems and methods for an indoor defined space, which employs conventional ANC technology combined with prediction techniques.

The technology will next be described in connection with certain illustrated embodiments and practices. However, it will be clear to those skilled in the art that various modifications, additions and subtractions can be made without departing from the spirit or scope of the claims.

BRIEF DESCRIPTION OF THE DRAWINGS

Advantages of the subject matter claimed will become apparent to those skilled in the art upon reading this description in conjunction with the accompanying drawings, in which like reference numerals have been used to designate like elements, and in which:

DETAILED DESCRIPTION

The subject matter presented herein provides for an active noise cancellation system. The active noise cancellation generates destructing interference signals within an interior of a defined space, wherein the defined space room has a coupling surface, such as a window or wall, separating the interior of the defined space from an exterior environment. Examples of a defined space include, but are not limited to a room, an apartment, an office, a barn and the like. The system comprises at least one exterior microphone configured to receive a plurality of audio signals generated in the exterior environment and a signal processor in electrical communication with the plurality of exterior microphones. The signal processor is configured to receive an audio signal from at least one of exterior microphones and generate an anti-noise signal which is designed to counteract the at least one audio signal generated in the exterior environment. The system also includes a transducer in electrical communication with the signal processor and attached to the coupling surface. The transducer is configured to receive the anti-noise signal from the signal processor and convert the anti-noise signal into a destructive interference audio signal propagated by the coupling surface. For example, the destructive interference may be a mechanical force generated by the transducer that causes vibration to a noise-coupling surface. The vibration of the noise coupling surface counteracts/cancels the vibration associated with the outside noise signals as they reach the noise-coupling surface.

Figure 1:
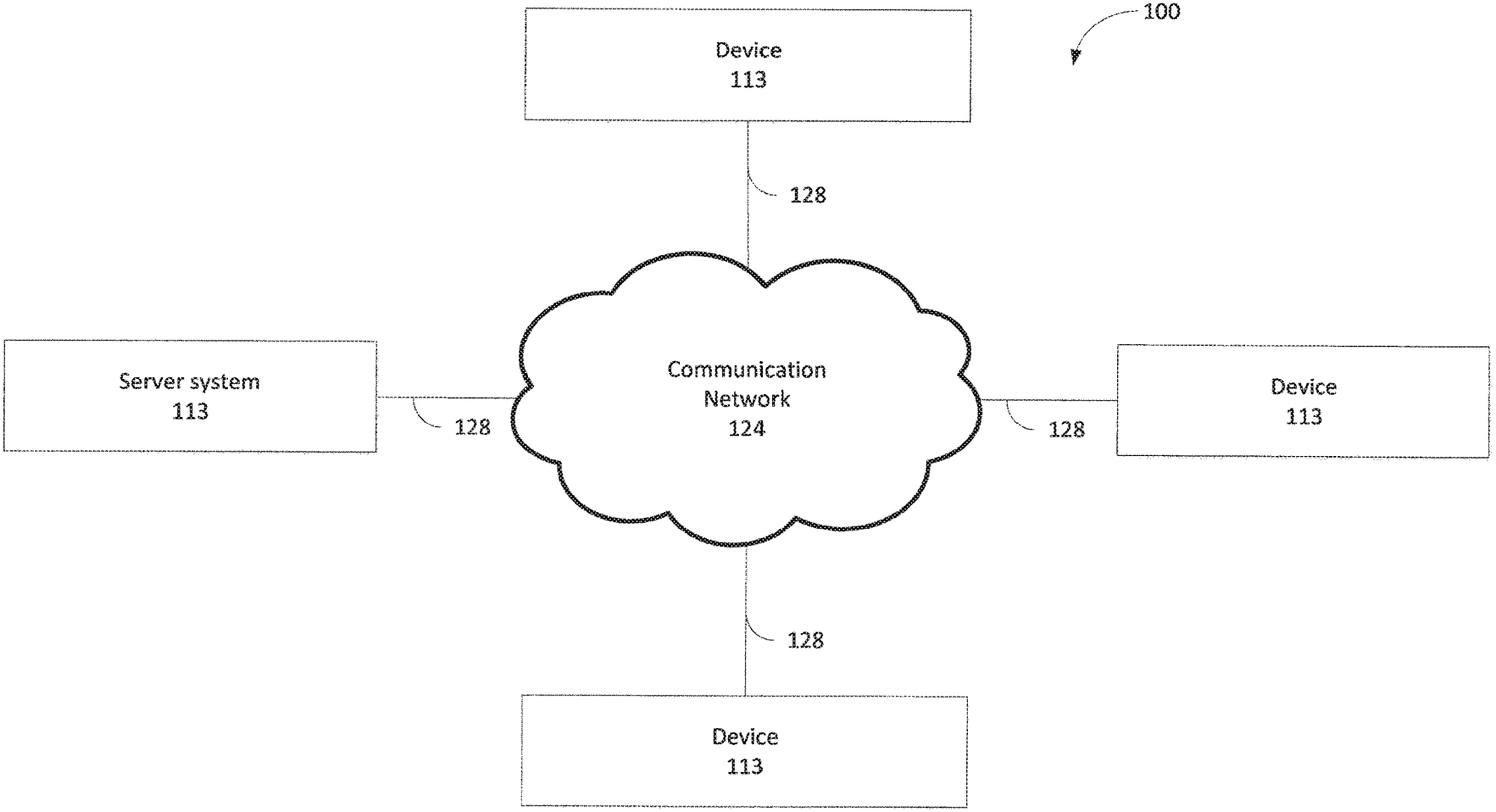
FIG. 1 illustrates a simplified block diagram of a distributed computer network in accord a some embodiments of the invention.

Prior to describing the subject matter in detail, an exemplary hardware device in which the subject matter may be implemented shall first be described. Those of ordinary skill in the art will appreciate that the elements illustrated in FIG. 1 may vary depending on the system implementation. FIG. 1 is a simplified block diagram of a distributed computer network 100. Computer network 100 includes a number of device systems 113, 116, and 119, and a server system 122 coupled to a communication network 124 via a plurality of communication links 128. There may be any number of devices and servers in a system. Communication network 124 provides a mechanism for allowing the various components of distributed network 100 to communicate and exchange information with each other.

Communication network 124 may itself be comprised of many interconnected computer systems and communication links. Communication links 128 may be hardwire links, optical links, satellite or other wireless communications links, wave propagation links, or any other mechanisms for communication of information. Various communication protocols may be used to facilitate communication between the various systems shown in FIG. 1. These communication protocols may include TCP/IP, HTTP protocols, wireless application protocol (WAP), vendor-specific protocols, customized protocols, and others. While in one embodiment, communication network 124 is the Internet, in other embodiments, communication network 124 may be any suitable communication network including a local area network (LAN), a wide area network (WAN), a wireless network, a intranet, a private network, a public network, a switched network, and combinations of these, and the like.

Distributed computer network 100 in FIG. 1 is merely illustrative of an embodiment and is not intended to limit the scope of the invention as recited in the claims. One of ordinary skill in the art would recognize other variations, modifications, and alternatives. For example, more than one server system 122 may be connected to communication network 124. As another example, a number of devices 113, 116, and 119 may be coupled to communication network 124 via an access provider (not shown) or via some other server system. Although only one centralized server is illustrated in FIG. 1, one skilled in the art would recognize that decentralized or server-less systems could be implemented in some embodiments.

Devices 113, 116, and 119 typically request information from a server system which provides the information. For this reason, server systems typically have more computing and storage capacity than device systems. However, a particular computer system may act as both a device and a server depending on whether the computer system is requesting or providing information. Additionally, although aspects of the invention have been described using a device-server environment, it should be apparent that the invention may also be embodied in a stand-alone computer system. Aspects of the invention may be embodied using a device-server environment or a cloud-computing environment.

Server 122 is responsible for receiving information requests from device systems 113, 116, and 119, performing processing required to satisfy the requests, and for forwarding the results corresponding to the requests back to the requesting device system. The processing required to satisfy the request may be performed by server system 122 or may alternatively be delegated to other servers connected to communication network 124.

Device systems 113, 116, and 119 enable users to access and query information stored by server system 122. In a specific embodiment, a "Web browser" application executing on a device system enables users to select, access, retrieve, or query information stored by server system 122. Examples of web browsers include the Internet Explorer browser program provided by Microsoft Corporation, and the Firefox browser provided by Mozilla Foundation, and others.

The device or server system may use a user interfaces with the system through a computer workstation system. The device or server system may include a monitor, screen, cabinet, keyboard, and mouse. Mouse may have one or more buttons such as mouse buttons. Cabinet houses familiar computer components, some of which are not shown, such as a processor, memory, mass storage devices, and the like.

Mass storage devices associated with the computers or server may include mass disk drives, floppy disks, magnetic disks, optical disks, magneto-optical disks, fixed disks, hard disks, CD-ROMs, recordable CDs, DVDs, recordable DVDs (e.g., DVD-R, DVD+R, DVD-RW, DVD+RW, HD-DVDf, or Blu-ray Disc), flash and other nonvolatile solid-state storage (e.g., USB flash drive), battery-backed-up volatile memory, tape storage, reader, and other similar media, and combinations of these.

A computer-implemented or computer-executable version of the invention may be embodied using, stored on, or associated with computer-readable medium or non-transitory computer-readable medium. A computer-readable medium may include any medium that participates in providing instructions to one or more processors for execution. Such a medium may take many forms including, but not limited to, nonvolatile, volatile, and transmission media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software of the present invention may be stored or reside in RAM or cache memory, or on mass storage device. The source code of the software may also be stored or reside on mass storage device (e.g., hard disk, magnetic disk, tape, or CD-ROM). As a further example, code may be transmitted via wires, radio waves, or through a network such as the Internet.

Figure 2:
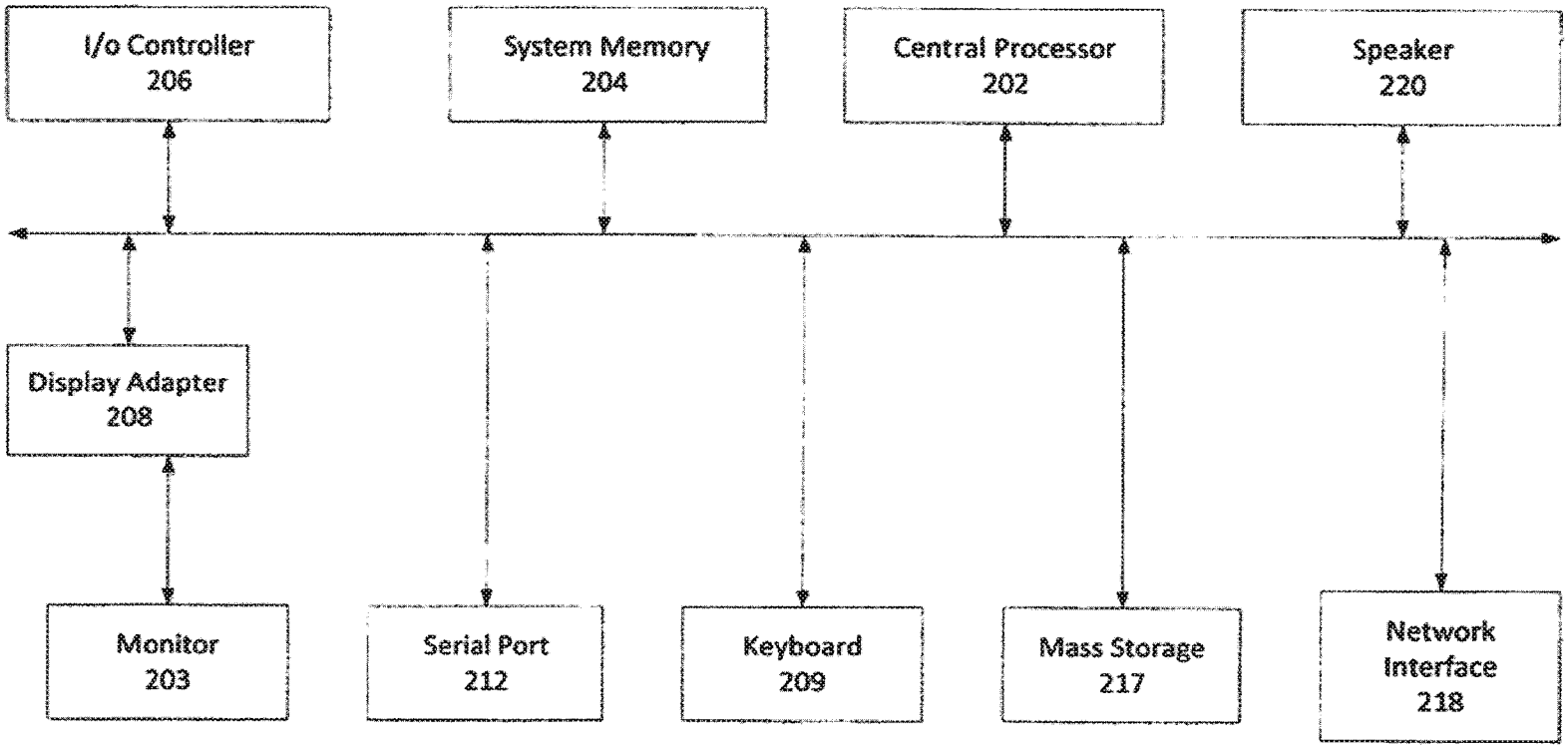
FIG. 2 illustrates a system block diagram of a computer system, such as the device or server systems in accordance with some embodiments of the invention.

FIG. 2 shows a system block diagram of a computer system, such as the device or server systems. The computer system includes monitor 203, keyboard 209, and mass storage devices 217. Computer system 201 further includes subsystems such as central processor 202, system memory 204, input/output (I/O) controller 206, display adapter 208, serial or universal serial bus (USB) port 212, network interface 218, and speaker 220. In an embodiment, a computer system includes additional or fewer subsystems. For example, a computer system could include more than one processor 202 (i.e., a multiprocessor system) or a system may include a cache memory.

Arrows, as illustrated in FIG. 2, represent the system bus architecture of computer system 201. However, these arrows are illustrative of any interconnection scheme serving to link the subsystems. For example, speaker 220 could be connected to the other subsystems through a port or have an internal direct connection to central processor 302. The processor may include multiple processors or a multicore processor, which may permit parallel processing of information. Computer system 201 shown in FIG. 2 is but an example of a suitable computer system. Other configurations of subsystems suitable for use will be readily apparent to one of ordinary skill in the art.

Computer software products may be written in any of various suitable programming languages, such as C, C++, C #, Pascal, Fortran, Perl, Matlab (from MathWorks), SAS, SPSS, JavaScript, AJAX, Java, SQL, and XQuery (a query language that is designed to process data from XML files or any data source that can be viewed as XML, HTML, or both). The computer software product may be an independent application with data input and data display modules. Alternatively, the computer software products may be classes that may be instantiated as distributed objects. The computer software products may also be component software such as Java Beans (from Oracle Corporation) or Enterprise Java Beans (EJB from Oracle Corporation). In a specific embodiment, the present invention provides a computer program product which stores instructions such as computer code to program a computer to perform any of the processes or techniques described.

An operating system for the system may be one of the Microsoft Windows® family of operating systems (e.g., Windows 95, 98, Me, Windows NT, Windows 2000, Windows XP, Windows XP x64 Edition, Windows Vista, Windows 7, Windows CE, Windows Mobile), Linux, HP-UX, UNIX, Sun OS, Solaris, Mac OS X, Alpha OS, AIX, IRIX32, or IRIX64. Other operating systems may be used. Microsoft Windows is a trademark of Microsoft Corporation.

Furthermore, the computer may be connected to a network and may interface to other computers using this network. The network may be an intranet, internet, or the Internet, among others. The network may be a wired network (e.g., using copper), telephone network, packet network, an optical network (e.g., using optical fiber), or a wireless network, or any combination of these. For example, data and other information may be passed between the computer and components (or steps) of the system using a wireless network using a protocol such as Wi-Fi (IEEE standards 802.11, 802.11a, 802.11b, 802.11e, 802.11g, 802.11i, 802.11ad, 802.11n, and Zigbee just to name a few examples). For example, signals from a computer may be transferred, at least in part, wirelessly to components or other computers.

In an embodiment, with a Web browser executing on a computer workstation system, a user accesses a system on the World Wide Web (WWW) through a network such as the Internet. The Web browser is used to download web pages or other content in various formats including HTML, XML, text, PDF, and postscript, and may be used to upload information to other parts of the system. The Web browser may use uniform resource identifiers (URLs) to identify resources on the Web and hypertext transfer protocol (HTTP) in transferring files on the Web.

As used herein Classical Active Noise Cancellation includes but is not limited to Feedforward(FF), Feedback (FB), Hybrid FF/FB, Filtered-X LMS(FxLMS), MFxLMS, MFxLMS1 And MFxLMS2, CFxLMS ,Variable threshold based FxLMS, Convex combination based FxLMS, VSS FxLMS, Data reusability based FxLMS, VSS FxLMS with variable tap length, FxWLMS & FxLMLS, methods involving Neural or Fuzzy logic.

Figure 3:
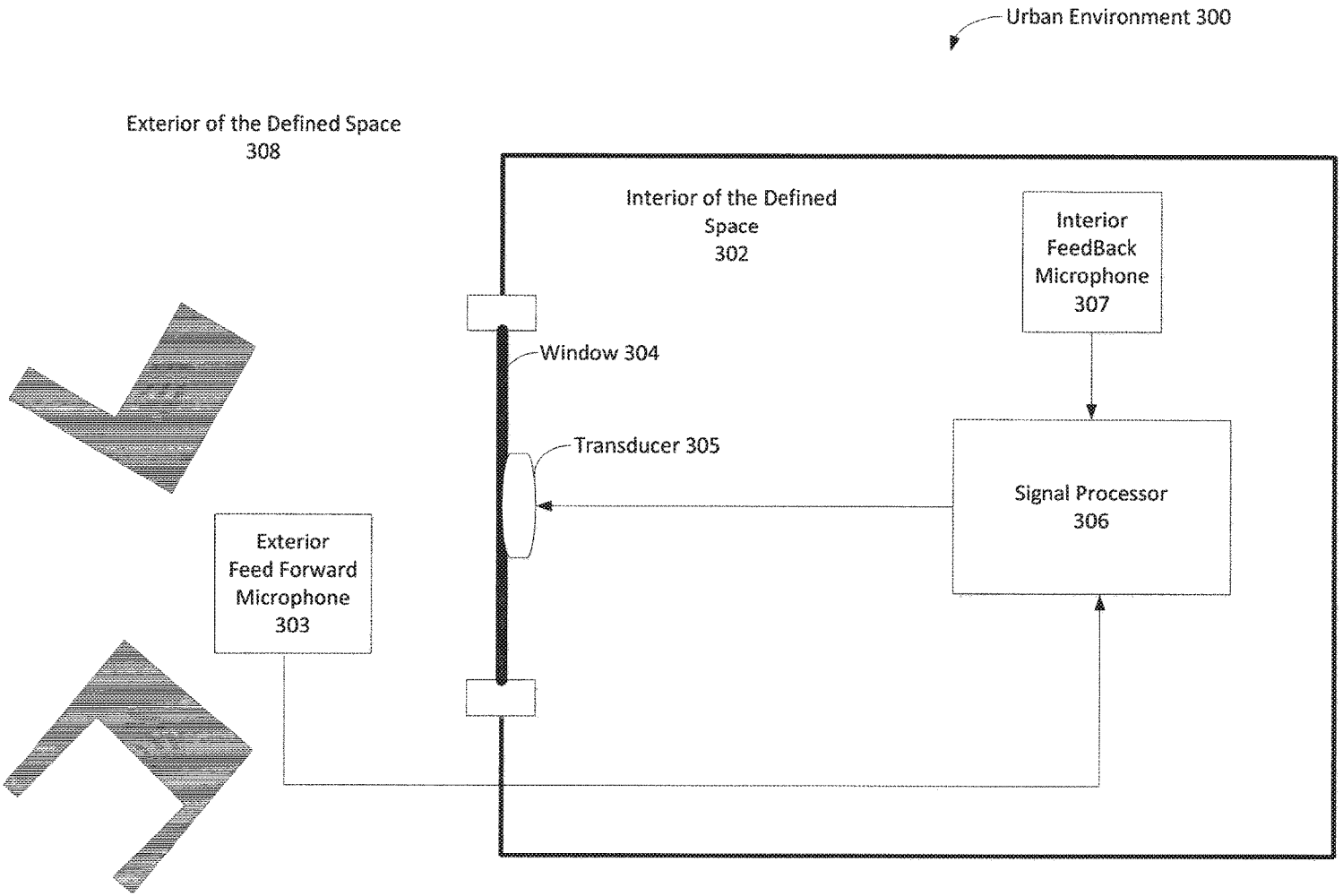
FIG. 3 is a block diagram illustrating an exemplary system configuration in accordance with some embodiments of the invention.

Referring now to FIG. 3, a block diagram illustrating an exemplary ANC system configuration in accordance with one or more embodiments of the technology.

The ANC system comprises an exterior microphone 303 placed in the exterior of a define space 308 of an urban environment 300, an interior microphone 307 placed in the interior of a defined space 302 the urban environment 300, a signal processor 306 that generates anti-noise signals based on the noise signals sent from the exterior and interior microphones 303 and 307, and a transducer 305 that is affixed to a noise coupling surface, such as a window 304 of the interior of the defined space 302 that converts the anti-noise signal into mechanical energy that causes the noise coupling surface, such as window 304, to vibrate in a pattern. The vibration of the noise-coupling surface, window 304, in the particular pattern counters the vibrations caused by the noise signal received by the exterior microphone 303 and essentially turns the surface of the noise-coupling surface, window 304, into a noise-cancelling speaker. Although the environment is labeled an urban environment in FIG. 3, the ANC system may be implemented in other environments, such as suburban environments, rural environments, and the like.

In more detail, the exterior microphone 303 is a feed forward microphone able to detect, pick up, and/or receive outside noises such as sirens, people, weather, car horns, etc. that encroach on the interior of the defined space 302 in the urban environment 300. The exterior microphone 303 is able to receive the outside noises before the outside noises are detected in the interior of the defined space 302 in the urban environment 300, because it is physically placed closer to the noise source than the interior of the defined space 302. Although one external microphone 303 is depicted in FIG. 3, more than one external microphone may be used.

As the outside noises are received or detected by the exterior microphone 303, the exterior microphone 303 sends the outside noise signals to the signal processor 306 electrically. Once the signal processor 306 receives the noise signals from the exterior microphone 307, the signal processor 306 determines noise waveform information that is the exact negative of the outside noise signals that were received from the exterior microphone 303. The determined exact negative of the outside noise signals are appropriately modified for the interior of the defined space 302. The signal processor 306 is able to generate an anti-noise signal associated with the determined appropriately modified noise waveform information and transmits the generated anti-noise signals to the transducer 305.

Once the transducer 305 receives the generated signal from the signal processor 306, the transducer 305 generates a corresponding destructive interference signals necessary for counteracting the outside noise signals as they impinge on the surface of the noise coupling surface, window surface 304. In one embodiment, the transducer 305 converts the signal into mechanical energy that causes the noise-coupling surface, window 304, to vibrate in a pattern. The vibration of the window in the particular pattern counters the vibrations caused by the noise received by the exterior microphone 303 and essentially turns the surface of the window 304 into a noise-cancelling speaker. The generated anti-noise signal from the signal processor 306 is received at the transducer 305 and the transducer generates a vibration pattern prior to or exactly when the outside noise signals reaches the window to cancel out the outside noise before the noise reaches interior of the defined space 302 of the urban environment 300.

As illustrated in FIG. 3, the transducer 305 is attached to the window (selectively such as by suction cup or some other removable contact, or permanently such as by glue, sticker or some other sustainable contact) to generate the destructive interference sound waves that will be propagated via the windowpane. The transducer 305 produces opposing signals (anti-noise signals) with the similar amplitude but with the opposite phase as the disturbing, intrusive noise, providing a significant reduction in noise level inside the interior environment 302. In such an embodiment, the transducer may be located within along the wall of the interior of the defined space 302 of the urban environment 300, within the wall of the interior of the defined space 302 of the urban environment 300, or anywhere within the interior of the defined space 302 of the urban environment 300.

The ANC system further includes an interior microphone 307 is located within the interior 302 of the urban environment 300. Although only one interior microphone 307 is displayed in FIG. 3, more than one interior microphone may be used. The interior microphone 307 is a feedback microphone. A feedback microphone is able to pickup and/or receive residual noise signals within the interior of the defined space 302 of the urban environment 300. Residual noise signals are noise signals that have not been cancelled by the destructive interference generated by the transducers. The feedback microphone 307 transmits the residual noise signal to the signal processor. Thereby, the interior microphone 307 will be able to monitor the resulting noise level within the interior of the defined space 302 of the urban environment 300 to monitor the efficiency of the noise cancellation produced by the transducer 305. For example, the transducer 305 may be generating a vibration pattern via window 304 to negate an outside noise signal of an engine hum picked up from an external microphone 303. If the internal microphone picks up or receives a noise signal of an engine hum, the vibration pattern of the transducer 305 is ineffective and may need to be improved.

In one embodiment, when noise signals are received by the interior microphone 307 and transmitted to the signal processor 306, the signal processor 306 may determine if the received noise is the same noise as the outside noise that caused the transducer to generate the vibration pattern. For example, if the signal processor 306 identifies the noise signal received by the interior microphone 307 as the engine hum noise signal, the signal processor 306 generates and transmits an anti-noise signal to the transducer 305 so that the transducer 305 can generate vibrations based on the anti-noise signal. If the signal processor 306 identifies the noise signal received by the interior microphone 307 as noise signals not heard by the exterior microphones 303, or heard by the exterior microphone 303 at a later time and with less intensity than the interior microphone 307, the signal processor may identify the noise signals as being generated from within the interior of the defined space 302 of the urban environment 300 and deem the noise as allowable noise singles that do not need to be cancelled. The signal processor 306 may identify noise signals that are likely to be generated from the interior of the defined space 302 of the urban environment 300 using the amplitude or time delay of the noise signal.

In some cases, the signal processor 306 may determine if the noise externally generated noise received from the interior microphone 307 is above a predetermined or adaptable threshold value. Based on the determination that the noise is above the certain threshold, the signal processor 306 generates an anti-noise signal and transmits the anti-noise signal to the transducer, so that the generated destructive interference produced by the transducer is modified based on the currently transmitted anti-noise signal.

Figure 4:
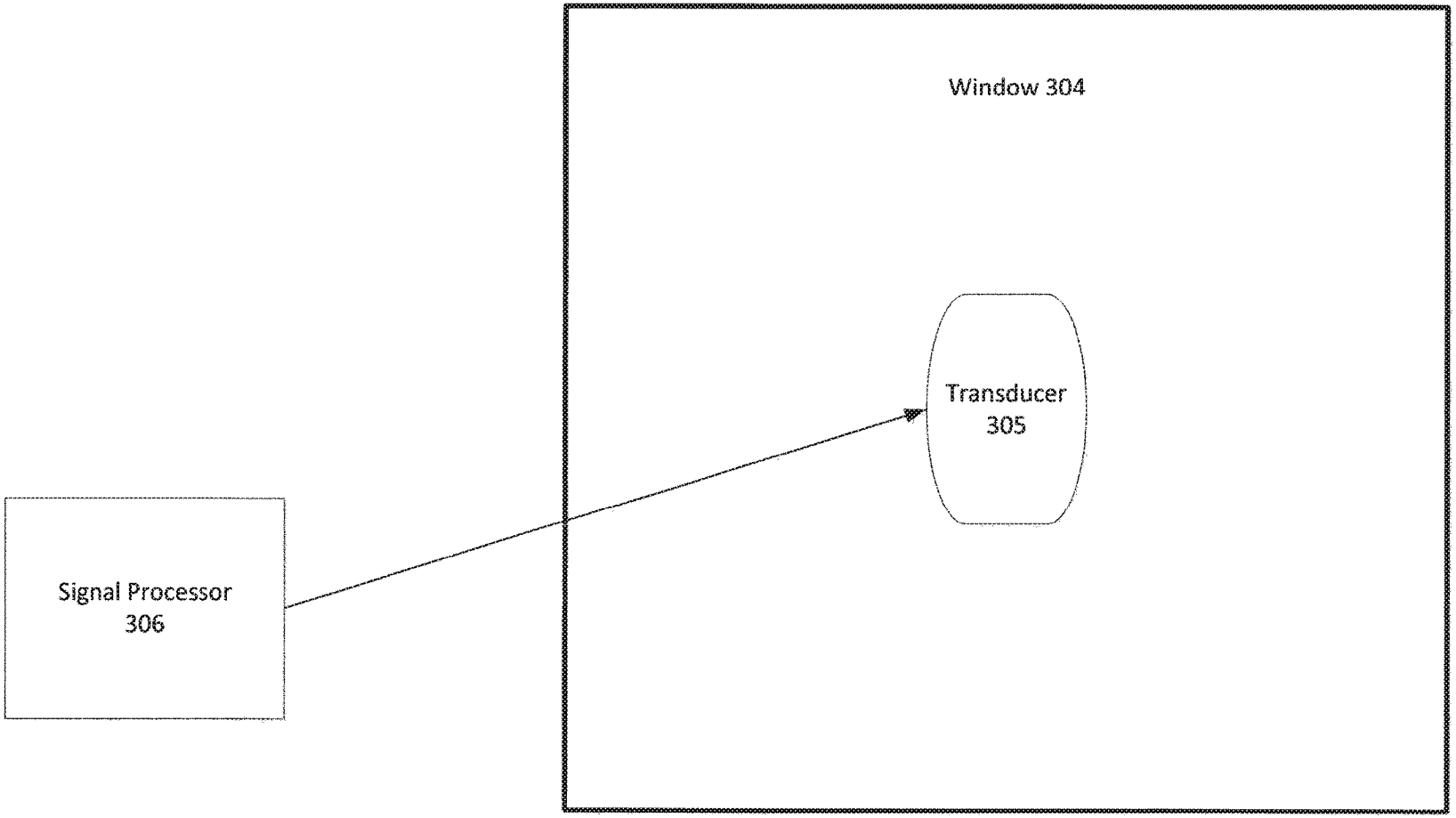
FIG. 4 is a block diagram illustrating installation of a transducer in accordance with some embodiments of the invention.
Figure 5:
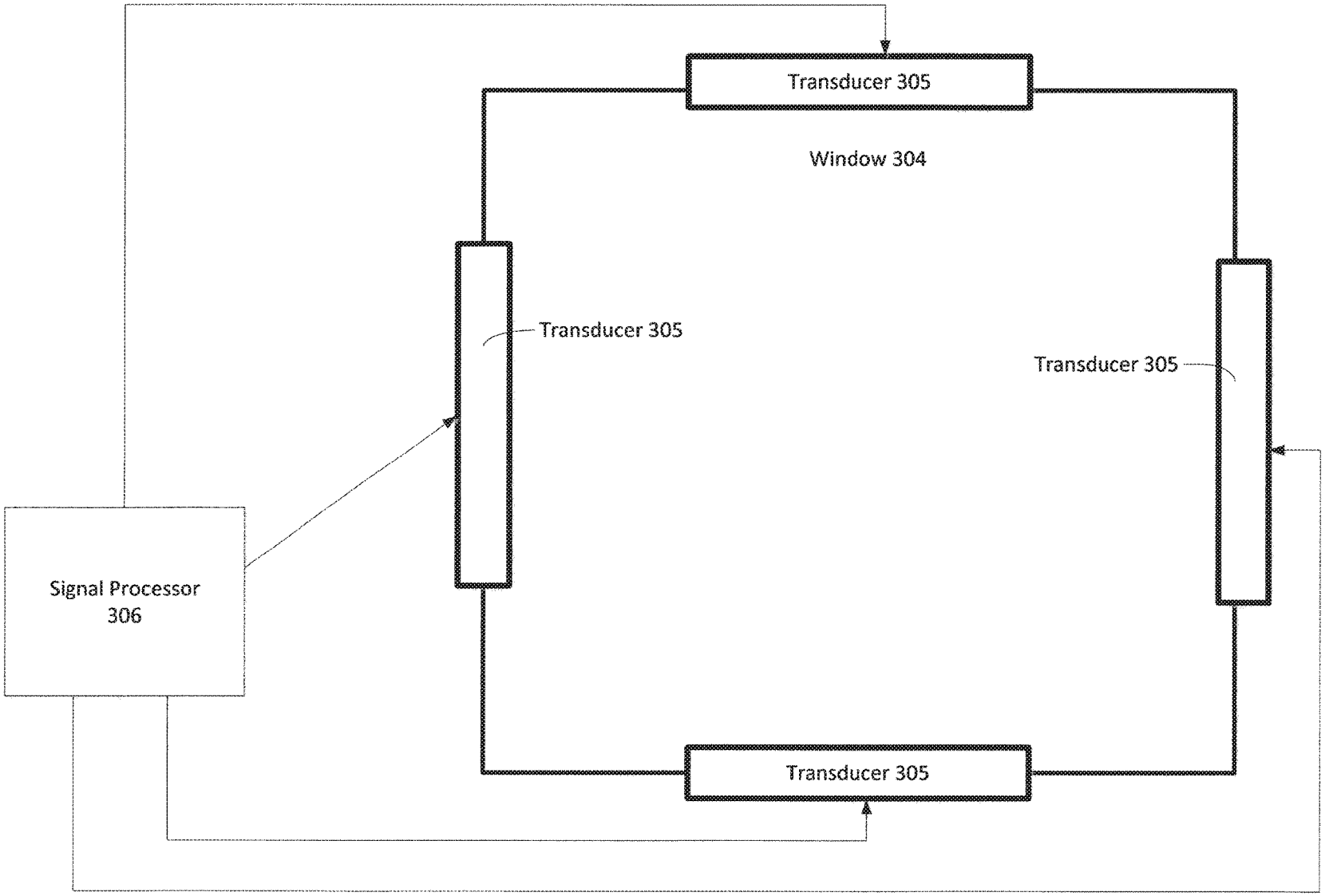
FIG. 5 is a block diagram illustrating installation of a transducer in accordance with some embodiments of the invention.
Figure 6:
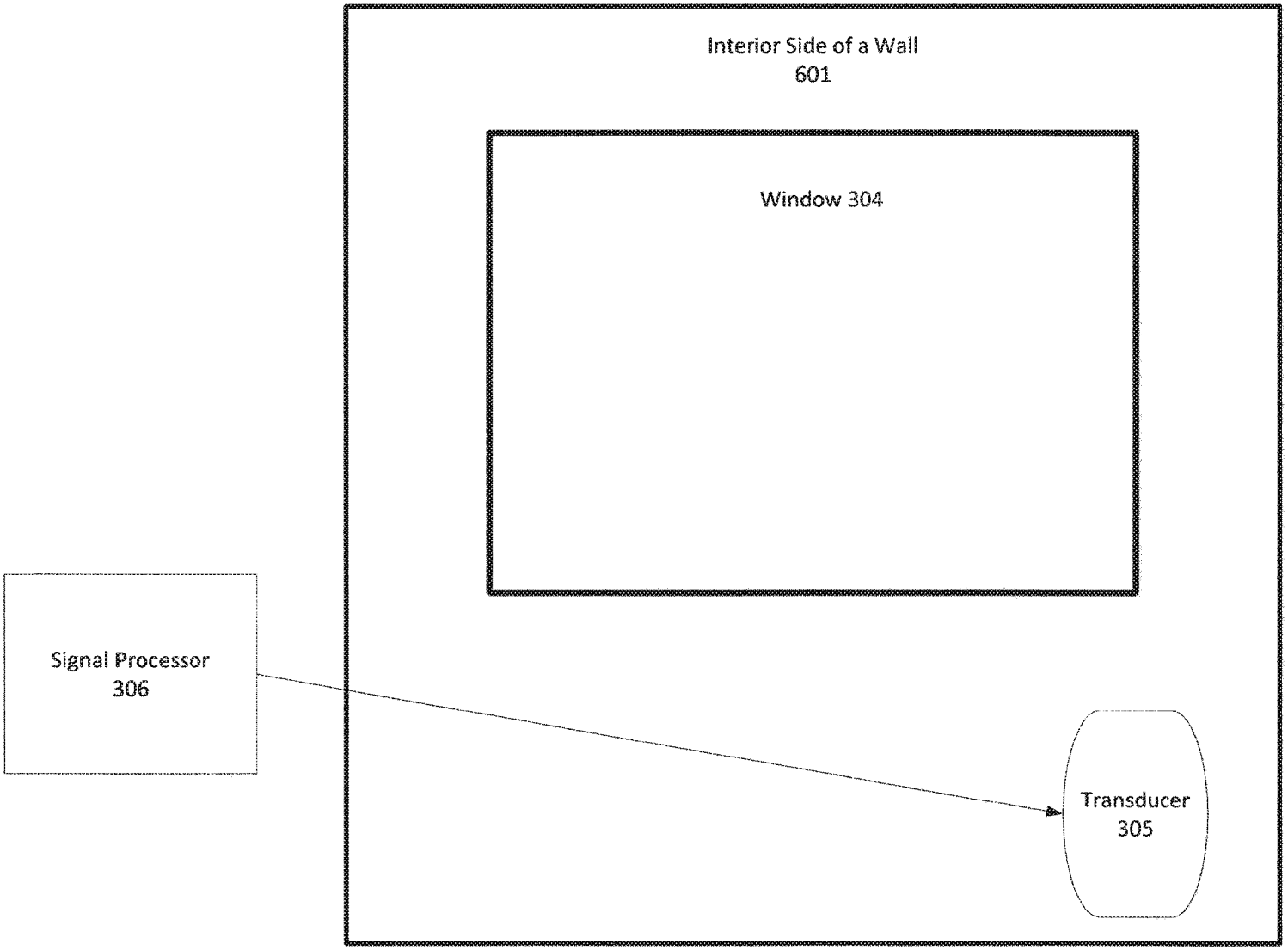
FIG. 6 is a block diagram illustrating installation of a transducer in accordance with some embodiments of the invention.

Referring now to FIG. 4-6, a block diagram illustrates installation of transducers in accordance with different embodiments of the technology.

The transducer may reside along the window sill/perimeter or on the center of the glass. The transducers may wirelessly receive information or signals from the signal processor wirelessly or the transducer may be physically wired to the signal processor.

When the transducer resides along the window sill/perimeter, this configuration would allow for similar cancellation capabilities without obstructing the view through the window caused by mounting the transducer in the center of the glass. In general, any configuration of transducer will involve some device, which transforms electrical signals from the ANC system into mechanical vibrations. A transducer alone would emit a weak acoustic signal, because of its small cross sectional area. By mating/coupling a transducer to a larger surface, the combined transducer-surface system now becomes an ad-hoc speaker. The transducer will transform its incoming electrical signals from the signal processor into physical motion, which will move whatever surface it happens to be attached to in a similar fashion.

Furthermore, windows are the focus of this analysis since in a typical high-rise deployment of this technology, the majority of external noise entering a defined space would be the noise coupled through the glass of an externally facing wall, as opposed to the wall structure (i.e. brick, wood, and concrete) because of their relative mechanical stiffness compared to glass. Glass will more readily flex and oscillate in response to external sound energy compared to stiffer construction materials. However, the method of ANC described in this patent is not limited to glass, and can be applied to wood, concrete, brick, etc., via simple resizing and/or retuning of the transducer elements. In either case, a glass or a structural mounting, the transducer's responsibility is to impart a force on the surface. That force will cause the surface to displace and vibrate according to its mechanical properties, which can be used to generate sound waves for ANC purposes. In this way, any type of transducer with a sufficient mass and/or energy can transform any surface into a sound-emitting source, like an ad-hoc speaker.

FIG. 4 illustrates a center transducer mounting. The center transducer mounting provides easy installation requiring no modification to the structure. Additionally, higher acoustic coupling efficiency may be achieved by placing the source of mechanical displacement (the transducer) at one of the antinodes of the coupling surface, i.e. the center of a rectangular pane of glass. Regardless the number of panes or the shape of the window, placing a transducer at one of these antinodes will allow for larger mechanical displacements for a given system, which translates into acoustic volume capability.

FIG. 5 illustrates an edge type transducer mounting. In an edge type transducer mounting, at least one transducer is placed on the mounting surface of the glass, i.e. along the edges of the glass. While typical construction practices will make this joint, between the glass and the frame, very stiff, it will still allow for coupling of some acoustic energy into the glass pane to cause a vibration pattern. With the edge type transducer mounting, views from the window are not obstructed and the transducers may be less visible or noticeable. The transducers may be communicatively coupled to each other and/or the signal process can be communicatively coupled to one or each of the transducers.

FIG. 6 illustrates an external transducer mounting. As discussed above, the transducer may be mounted on a wall that is an external facing wall, in an external facing wall or in the vicinity of an external facing wall. In some embodiments, if the transducer is not mounted on glass, but rather mounted or placed near an external facing wall, then the transducer may generate a counteractive noise by applying mechanical force to the surface which causes a vibration to cancel out the outside noise.

Figure 7:
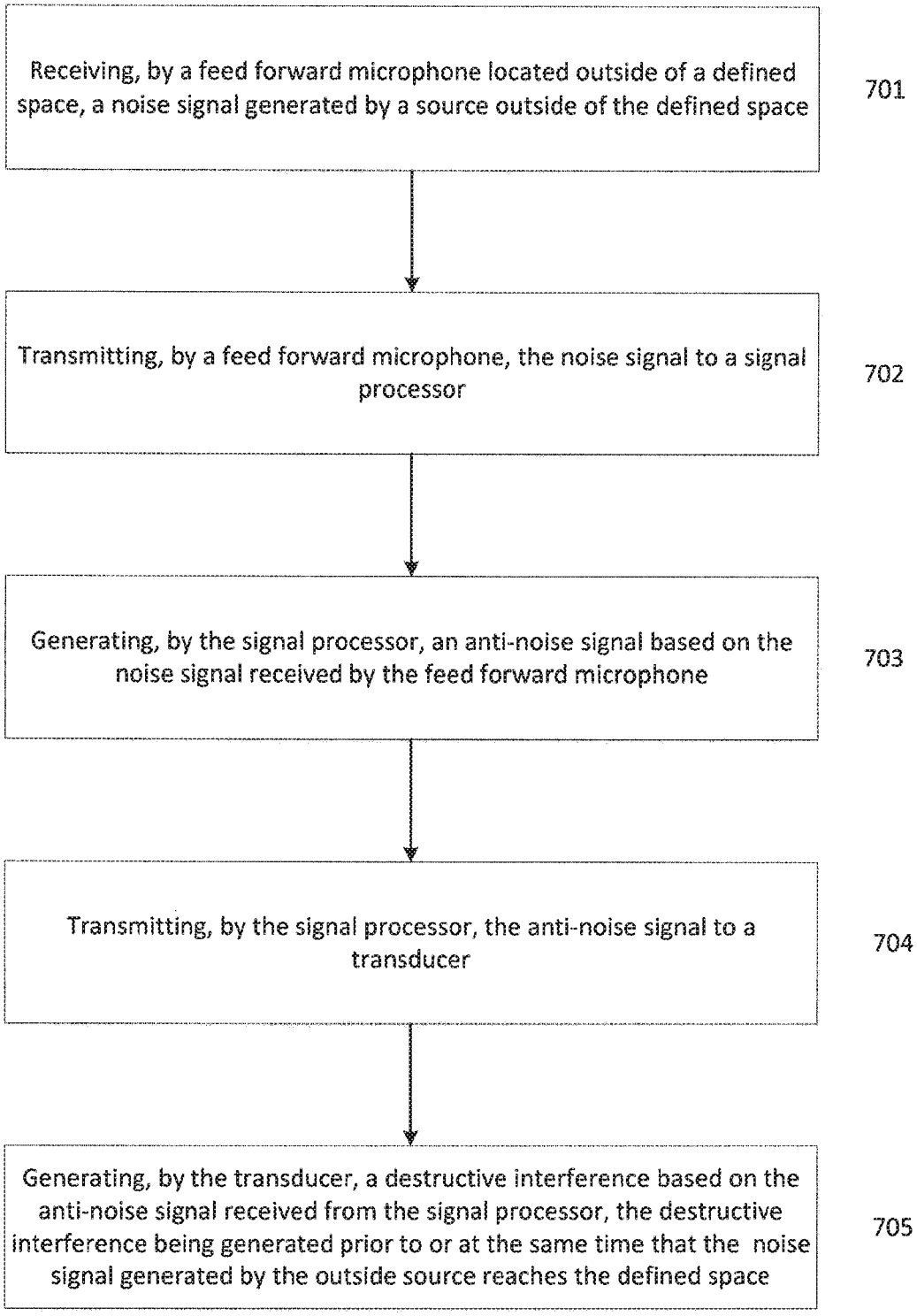
FIG. 7 illustrates a flow diagram of a feed forward noise cancelling system in accordance with some embodiments of the invention.

Referring now to FIG. 7, a flow diagram illustrates a feed forward noise cancelling system. The feed forward noise cancelling system comprises a signal processor processing outside noise signals received from an external feed forward microphone and transmitting generated signal to a transducer in accordance with different embodiments of the technology.

In step 701, an exterior microphone located outside of a defined space and having feed forward capabilities receives or picks up dynamic and/or static noise signal or signals that have been generated by a source outside of the defined space. For example, an exterior microphone placed outside of a defined space receives noise signals, such as sirens, horns, dogs barking, noisy air conditioners and the like.

In step 702, the exterior microphone transmits the outside dynamic and/or static noise signals or signal to a signal processor. The exterior microphone may be hard wired to the signal processor or may be wirelessly coupled to the signal processor.

In step 703, the signal processor generates an anti-noise signal based on the noise signal received by the feed forward microphone. Specifically, in some embodiments, the signal processor analyzes the waveform of the received dynamic and/or static noise signals received from the exterior microphone. The signal processor then uses an algorithm or a plurality of algorithms to generate a signal or signals that will either phase shift or invert the polarity of the received noise signal or signals. This inverted signal (in anti-phase) is then amplified and filtered so that a transducer can create a sound wave directly proportional to the amplitude of original waveform creating destructive interference.

In step 704, the signal processor transmits the anti-noise signal to the transducer. In one embodiment, the anti-noise signal may be enhanced with necessary gains, delays, and filtration by the signal processor so that the transducer can generate a more effective sound wave that creates a destructive interference. The signal processor may be hard wired to the transducer or may be communicatively coupled to the transducer.

In step 705, once the transducer receives the anti-noise signal, the transducer can generate a destructive interference, such as mechanical forces and electrical pulse pattern, based on the received anti-noise signal. When the mechanical forces are applied to a window, the displacements/vibrations of the window generate a sound wave that creates a destructive interference. The destructive interference is generated at the precise time to achieve an optimal noise change so that the outside noise that enters the interior of the defined space is optimally minimized. The precise time to achieve an optimal noise change may be calculated by dividing the distance between the exterior microphone and the noise coupling surface, and the speed of sound at the specific location of the defined space. The speed of sound can change based on the atmospheric pressure and temperature of the specific location.

In one embodiment, the outside noise signals reach the window or exterior-facing walls of the defined space at the same die or after the transducer generates the mechanical vibrations or the audible sound wave to create the destructive interference.

Figure 8:
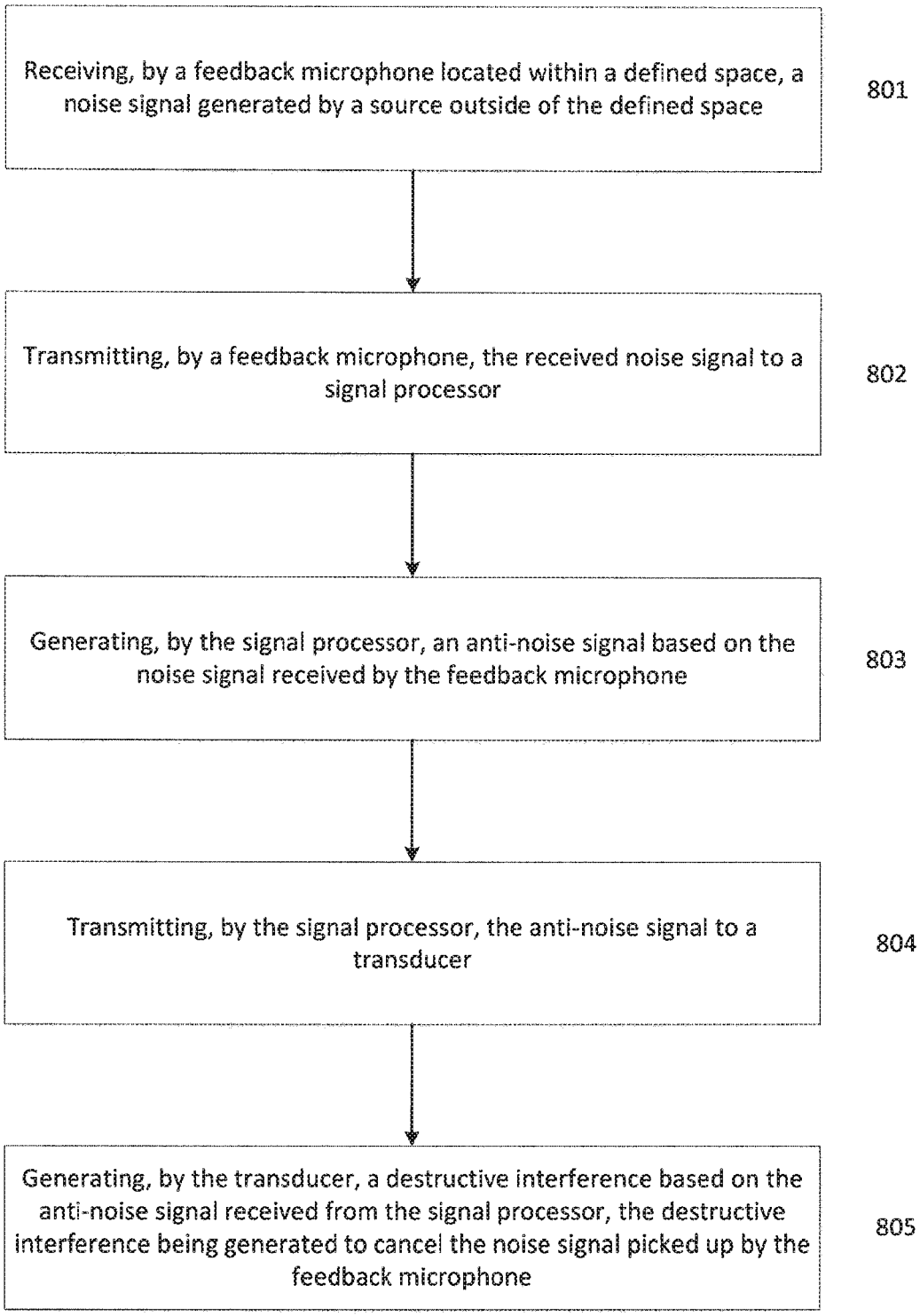
FIG. 8, a flow diagram illustrates a feedback noise cancelling system in accordance with some embodiments of the invention.

Referring now to FIG. 8, a flow diagram illustrates a feedback noise cancelling system. The feedback noise cancelling system comprises a signal processor processing interior noise signals received from an interior feedback microphone and transmitting generated signal to a transducer in accordance with different embodiments of the technology.

In step 801, an interior microphone located within a defined space and having feedback capabilities receives or picks up dynamic and/or static noise signal or signals that have been generated by a source outside of the defined space. For example, an interior microphone placed within the interior of a defined space receives noise signals that originated in the exterior of the defined space but can be heard in the interior of the defined space.

In step 802, the interior microphone transmits the received noise signal or signals to a signal processor. The interior microphone may be hard wired to the signal processor or may be wirelessly coupled to the signal processor.

In step 803, the signal processor generates an anti-noise signal based on the noise signal received by the feed forward microphone. In one embodiment, the signal processor analyzes the waveform of the received noise signals received from the interior microphone. The signal processor then uses an algorithm or a plurality of algorithms to generate a modified signal or signals that will either phase shift or invert the polarity of the received noise signal or signals. This inverted signal (in anti-phase) is then amplified and filtered so that a transducer can create a sound wave directly proportional to the amplitude of the received waveform, creating an enhanced destructive interference.

In step 804, the signal processor transmits the anti-noise signal to the transducer. In one embodiment, the anti-noise signal is enhanced with necessary gains, delays, and filtration so that the transducer can generate a more effective sound wave that creates a destructive interference.

In step 805, once the transducer receives the anti-noise signal the transducer can generate a destructive interference to cancel the noise signal picked up by the interior microphone. In one embodiment, the transducer generates mechanical forces. When the mechanical forces are applied to a window or another noise coupling surface, the displacements/vibrations of the window or surface generates a sound wave that creates destructive interference.

Figure 9:
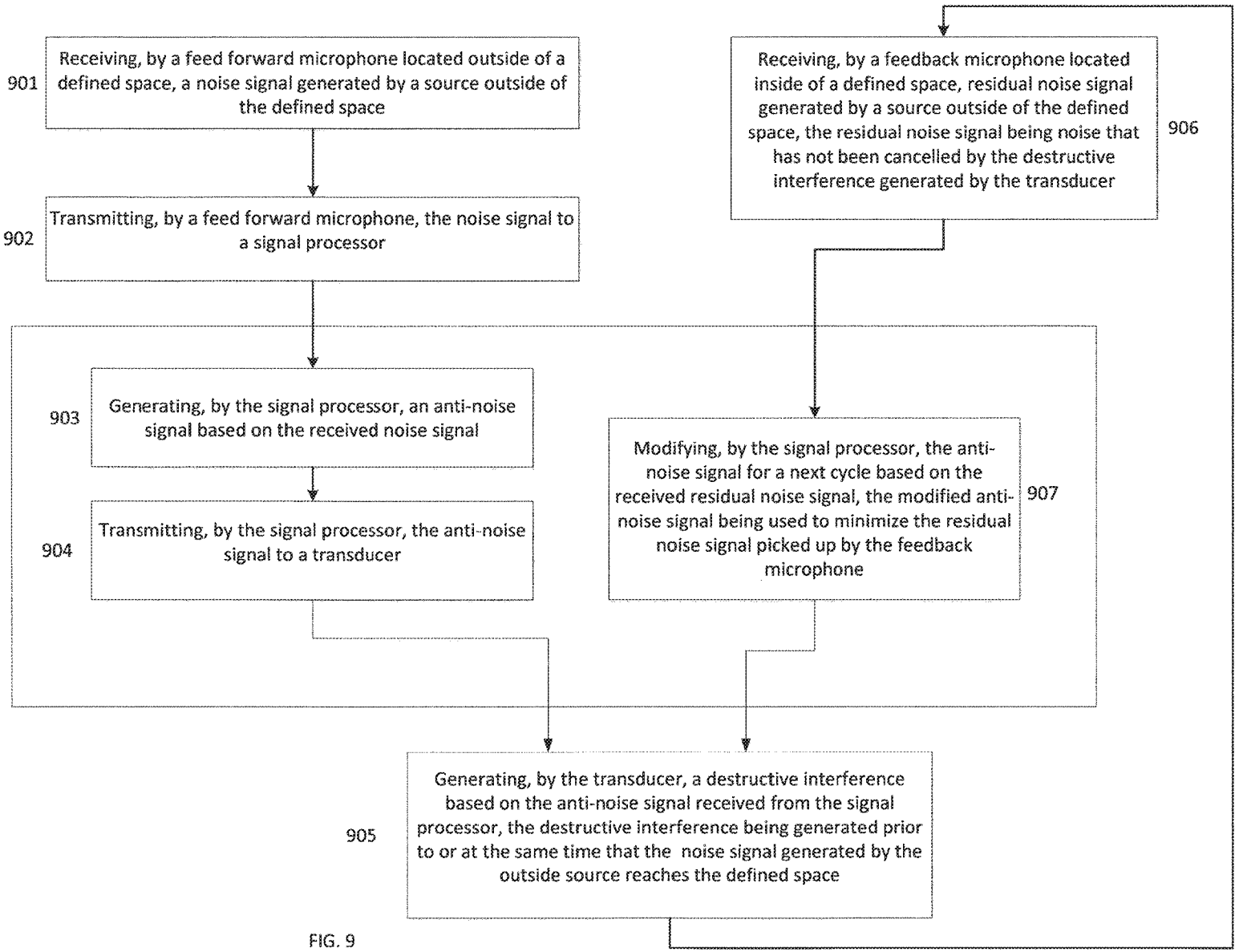
FIG. 9 illustrates a flow diagram of a hybrid feed forward/feedback noise cancelling system in accordance with some embodiments of the invention.

Referring now to FIG. 9, a flow diagram illustrates a hybrid feed forward/feedback noise cancelling system. The feedback noise cancelling system comprises a signal processor processing noise signals received from both an exterior feed forward microphone and an interior feedback microphone and transmitting generated signal to a transducer in accordance with different embodiments of the technology.

In step 901, a feed forward microphone located outside of a defined space receives or picks up noise signals generated by a source outside of the defined space. For example, an exterior microphone located exterior portion of the defined space picks up noise signals from generated in the exterior portion of the defined space.

In step 902, the feed forward microphone transmits the noise signals picked up by the feed forward microphone to a signal processor. In one embodiment, the feed forward microphone transmits an electrical signal that is associated with the noise signal to the signal processor.

In step 903, the signal processor generates an anti-noise signal as described above, based on the received noise signal. Necessary gains, delays and filters have been incorporated into the calculation for the anti-noise signal.

In step 904, the signal processor transmits the anti-noise signal to the transducer.

In step, 905, the transducer generates a destructive interference based on the anti-noise signal received from the signal processor. For example, the transducer generates mechanical forces that cause a window or surface to vibrate or a sound wave based on the anti-noise signal received by the signal processor. The vibration is a destructive interference to the noise signal received from the exterior microphone. The exterior noise signal reaches the surface where the transducer is mounted at the same time or after the transducer has created the vibrations so that the noise signal does not pass into the interior of the defined space.

In step 906, the interior feedback microphone picks up any residual noise signal that is audible and not cancelled by the destructive interference created by the transducer. The interior feedback microphone then transmits the residual noise signal to the signal processor.

If the interior feedback microphone does not pick up any residual noise signal that is audible and not cancelled by the destructive interference created by the transducer, then the interior feedback microphone continues to monitor for residual noise signals.

In step 907, the signal processor modifies the anti-noise signal for the next monitoring cycle to improve its performance in order to minimize the residual noise signal reported by the feedback microphone. The modified anti-noise signal is sent to the transducer so that the transducer can generate another destructive interference based on the modified anti-noise signal.

In one embodiment, the signal processor may determine if the received residual noise signal originated from the exterior of the defined space and is associated with the noise signal received from the exterior microphone, or whether the noise signal received from the interior feedback microphone originated from within the defined space. For example, the signal processor may be able to distinguish an engine hum noise signal that is associated with an engine hum noise signal received previously from the external feed forward microphone and people talking within the defined space. In such an embodiment, the signal processor may modify the anti-noise for only the engine hum noise signal not the people talking noise signal. Another example of how the system may discern interior versus exterior noise is to compare the time delay between the feed forward and feedback microphones. If a signal is heard on the internal microphone first, and then at a later time with less intensity, a similar signal is heard on the external microphone, the signal likely originated from inside the environment. However, if the signal is first heard with a higher intensity outside the environment, and then at a later time heard inside the environment with a lesser intensity, then the signal likely originated from outside the environment.

Figure 10:
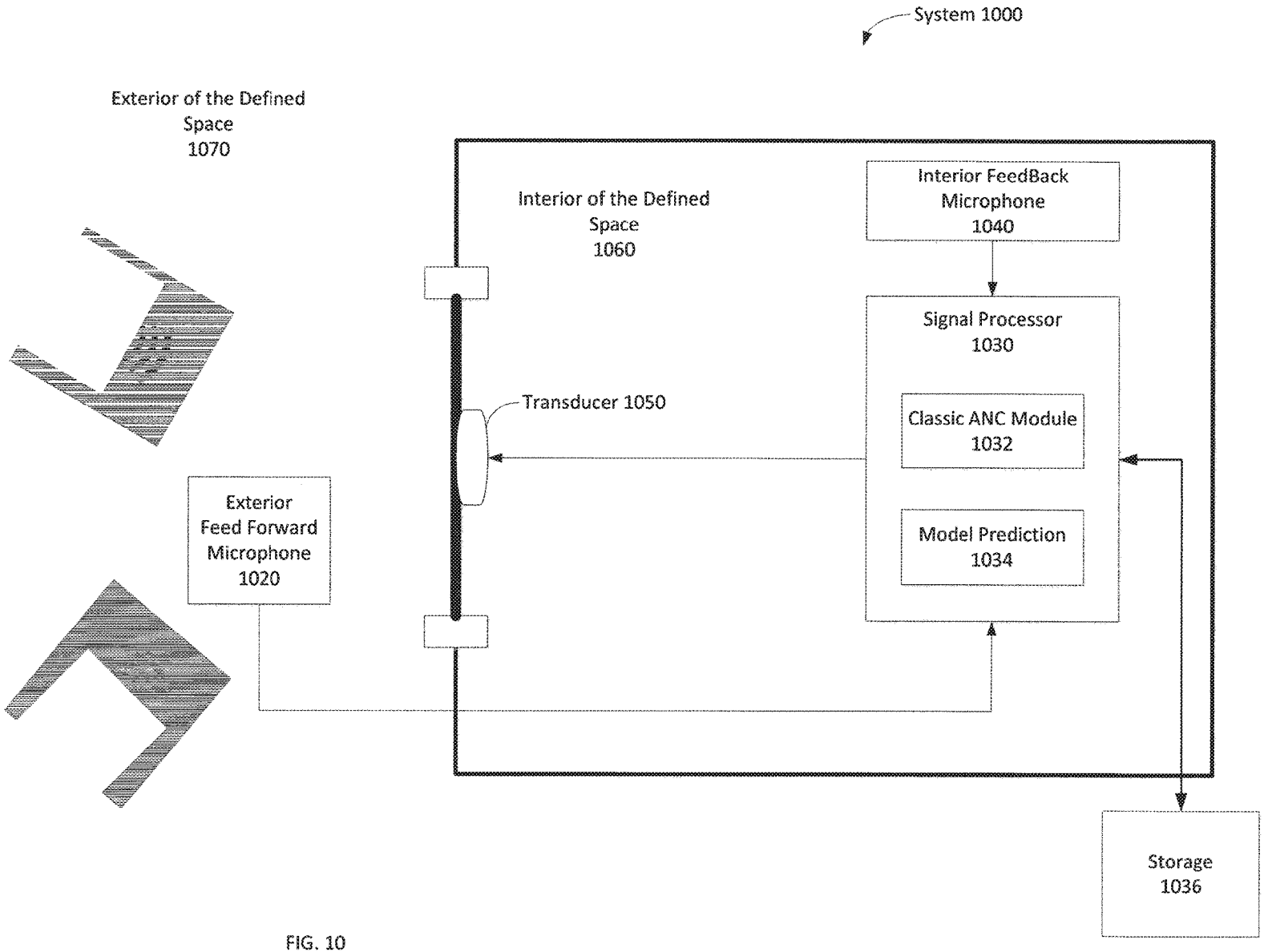
FIG. 10 illustrates a block diagram of a predictive model-based noise cancellation system in accordance with some embodiments of the invention.

Referring now to FIG. 10, a block diagram illustrates a predictive model-based noise cancellation system. The predictive model based noise cancellation system combines the features of a classic ANC module, that may include a feed forward and feedback noise cancellation systems, and prediction models. The predictive model based noise cancellation system provides for better detection and generation of destructive interference of noise signals. For example, using the predictive model based noise cancellation system, a signal processor can quickly scan a library of previously heard and common noises, such as police sirens, a plane flying, a helicopter buzzing, and the like, and use the noise's predictability to better anticipate and quickly generate a destructive interface sound wave.

The system 1000 illustrated in FIG. 10 comprises an exterior feed forward microphone 1020 located outside of an defined space 1070 for receiving or picking up noise signals occurring in the exterior of the defined space 1070 and optionally an internal feedback microphone 1040 for receiving or picking up noise signals audible from inside a defined space 1060. Electrical signals associated with the noise signals from the exterior and optional interior microphones 1020 and 1040 are transmitted to a signal processor 1030.

The signal processor 1030 can include, but is not limited to, a classic ANC module 1032, which may include a plurality of feed forward, feedback or hybrid feed forward and feedback, a model prediction module 1034 and storage

1036. The model prediction module 1034 receives the noise signal from the exterior and/or interior microphones and determines if the noise signal is stored in a library of noise signals within the storage 1036.

The noise signal is forwarded to the classical ANC module 1032 which can operate with a plurality of algorithms previously discussed and repeated here for convenience. The classic ANC module 1032 can include but is not limited to Feedforward (FF), Feedback (FB), Hybrid FF/FB, Filtered-X LMS (FxLMS), MFxLMS, MFxLMS1 And MFxLMS2, CFxLMS, Variable threshold based FxLMS, Convex combination is on based FxLMS, VSS FxLMS, Data reusability based FxLMS, VSS FxLMS with variable tap length, FxWLMS and FxLMLS. Module 1032 will always operate in order to try to cancel out as much of the incoming noise signal as possible. In parallel, the model prediction module 1034 will also operate in order to augment the system's performance.

In regards to the model prediction module 1034, there are several ways of detecting this match between observed microphone samples and existing models. Techniques for the match detection include, but are not limited to, time-correlation techniques, least-mean-squares, Kalman filters, Fourier analysis, Bayesian methods, statistical methods, methods involving machine learnering, polymoial fitting, Monte-Carlo methods, linear regression, regularization, direct pule-respose identification, wavelet methods, Hammerstein-Wiener methods, and nonlinear least squares.

If the system determines that an existing or already observed noise is currently being presented to the signal processor 1030, the signal processor 1030 will (1) lookup the noise model's time evolution to determine what the next following samples of the microphone might look like(i.e. predict the next sounds), and actively track the noise correlation. The signal processor 1030 can use the information to generate anti-noise signals to transmit to the transducer 1050 in order to augment the actions of the classical ANC module 1032.

The signal processor 1030 will also (2) report the positive identification of a library noise model. The report can be sent to a larger network of ANC systems, regardless of size. For example, the ANC ID match can be reported to other ANC devices in the same room, same collection of rooms, same apartment, same floor of apartments, same building, or same neighborhood area of buildings. The benefit will be that the positive matching of noise model can be sent to other ANC devices before the noise signal acoustically reaches those devices so that they can better try to cancel the noise signals. The positive ID will also help when used in conjunction with reinforcement learning methods to strengthen the belief/memory of an identified noise signal.

If the noise signal is stored within the library, then the model prediction module 1034 uses the library to predict the future evolution of the noise signal. The library includes a representative record for each noise signal. Each record for each noise signal includes information associated with a predicted evolution of the noise. For example, a noise signal of a police siren has an associated time base, relative profile of amplitude, time-evolving frequency content, time-evolving phase content, and perhaps stochastic or random acoustic inclusions over the period of interest. The record in the library storing a police siren noise signal would similarly include an associated time base, relative profile of amplitude, time-evolving frequency content, time-evolving phase content, and perhaps stochastic or random acoustic inclusions over a period. In the example, the noise signal that is received may be of the police siren at amplitude minimum in frequency/tone. The model prediction module 1034 would compare the received noise signal of the police siren with the records of noise signals stored in records in the library. This comparison can use various algorithms to determine a correlation that can include but is not limited to, time-correlation techniques, least-mean-squares, Kalman filters, Fourier analysis, Bayesian methods, statistical methods, methods involving machine learning, polynomial fitting, Monte-Carlo methods, linear regression, regularization, direct pulse-response identification, wavelet methods, Hammerstein-Wiener methods, and nonlinear least squares. In this example, the noise signal of the police siren matches the first few samples of a record storing the minimum frequency/tone noise signal during a portion of a police siren. The model prediction module 1034 will then be able to predict that the police siren noise signal will be followed by a time-evolving tone in frequency that climbs to a maximum in a sinusoidal fashion according to the model. Using the time-evolving model of the police siren noise signal, the observed microphone samples, the time-correlation between the two, information about the predicted evolution of the noise signal is transmitted to transducer 1050.

Each record within the library stored in storage 1036 captures and represents typical sounds heard in the environment, for example, a police siren. Different environments like cities or suburbs will have various noise profiles and therefore need various noise records. For example, the library may be customized for different locations since in different locations noises vary, as depicted by sirens in Europe having different noise signals and sounds than sirens in the US. Additionally, suburban environments face different unpleasant noises such as lawnmowers, leaf blowers, snow plows, etc. than urban environments.

Each record is a predictive model of a noise signal. The noise signals stored in the library are not limited to periodic or frequent noises. However, periodic or frequent noises are easier to model. This periodicity can be taken advantage of and modelled using various techniques to capture the time-evolving nature of the sound signal, and not just for police sirens. How the sound is modeled can vary for this application, so long as a faithful model is made. Examples of how to build these models can include, but are not limited to, least-mean-squares, Kalman filters, Fourier analysis, Bayesian methods, statistical inference, methods involving machine learnering, polymoial fitting, system identification techniques, linear regression, regularization, direct pule-respose identification, wavelet methods, Monte-Carlo methods, Hammerstein-Wiener methods, parametric model ID, and nonlinear least squares. The police siren discussed above is only one example of the noise that can be modeled with these techniques, but there is no limit on these types of signals. More periodic signals will be easier to model, but it is not a strict requirement. Each environment will necessitate its own representative library of noise models. A benefit of generating region-based libraries is that multiple users in the same region can benefit and contribute to the model library. Finally while this modeling can happen on-line, that is during normal ANC operation, the modeling and library generation can also happen off-line, without any ANC, with only microphones in the region of interest.

If, however, the noise being presented to the model prediction module 1034 is a new noise signal, one that has not been observed or heard by the signal processor 1030 or stored in the library storage 1036, the model prediction module 1034 will begin to perform a noise signal recording as part of a machine learning process. This recording is considered a candidate noise signal and will be stored in the library 1036, but is not yet used for ANC. This candidate signal is considered to have a low confidence metric because it was only observed once or a handful of times. It may not be useful yet to incorporate it into the ANC scheme because, (1) the candidate noise recordings do not yet faithfully represent the actual noise signal because of statistical noise, and (2) the candidate signal may be a single event or rare event which is not worth devoting resources to. Therefore, the model prediction module 1034 will consider the candidate signal stored in 1036 as a temporary item. If the candidate signal is observed again and enough times within a certain period of time, the confidence metric of the candidate signal will grow. Once the confidence metric crosses a threshold, the candidate signal is then considered a bonafide noise signal for the given environment, the exterior of the defined space 1070. Its confidence metric is a piece of information that will always be tied to the noise signal model which allows the system to know how much it can rely on the information within the noise model to cancel unwanted noise signals.

Each time the model prediction system 1034 observes a noise signals which it can match to a candidate signal or a bonafide signal in the model library stored in storage 1036, that model's confidence metric will incrementally increase. Furthermore, the noise models will be altered and improved with each observation by various methods which can include, but are not limited to, least-mean-squares, Kalman filters, Fourier analysis, Bayesian methods, statistical inference, methods involving machine learnering, polymoial fitting, system identification techniques, linear regression, regularization, direct pule-respose identification, wavelet methods, Monte-Carlo methods, Hammerstein-Wiener methods, parametric model ID, and nonlinear least squares.

In one embodiment of the system, there may be a forgetting factor, which periodically decreases uniformly the confidence metrics of all the noise models in the library stored in storage 1036. The purpose of this forgetting factor is to eliminate false candidate of noise signals and noise signals that may have once been present and common in the environment, the exterior of the defined space 1070, but are no longer being observed.

Typically, the classic ANC module 1032 will generate its own anti-noise signal in parallel with the model prediction module 1034. The signal processor 1030 will perform a combination of these two anti-noise signals to produce the singular signal that is sent to the transducer 1050. There are many ways to perform this combination of signals, but one example is a weighted sum between the two sources. For example, the signal processor 1030 can combine the classic ANC 1032 results with a weighted version of the model prediction module's 1034 results, where the weight applied to the model prediction anti-noise signal is a function of the confidence metric of the noise model being currently observed. In this way older more refined noise models found in the library 1036, will be able to contribute more to the noise cancelling performance of the system, while newer less well-learned models will only contribute a small amount.

While trying to actively cancel modeled noises, the ANC system can use interior or error microphones 1040 to determine how well the system is doing at cancelling the noise. These error measurements can be used to modify and improve the library of models to optimize the performance of the ANC system. The claims are not limited to any specific learning method, and can include but is not limited to, all the prior methods described in the modeling and detection steps above, error analysis, least mean squares, and Monte-Carlo methods. Finally any modifications or lessons learned will be incorporated back into the library of noise models, like in reinforcement learning. This library can also be shared with other ANC devices in the same room, same collection of rooms, same apartment, same floor of apartments, same building, or same neighborhood area of buildings. Finally because the regions in which ANC will be used non-static for example a fire truck changes its sirens or an airport starts using a different airplane both which will produce new noise signals, the ANC model prediction system will be able to actively modify existing models if it seems that the environment is slowly adapting, or create a new model if the difference is significant enough, so that the ANC system is always up to date.

Figure 11:
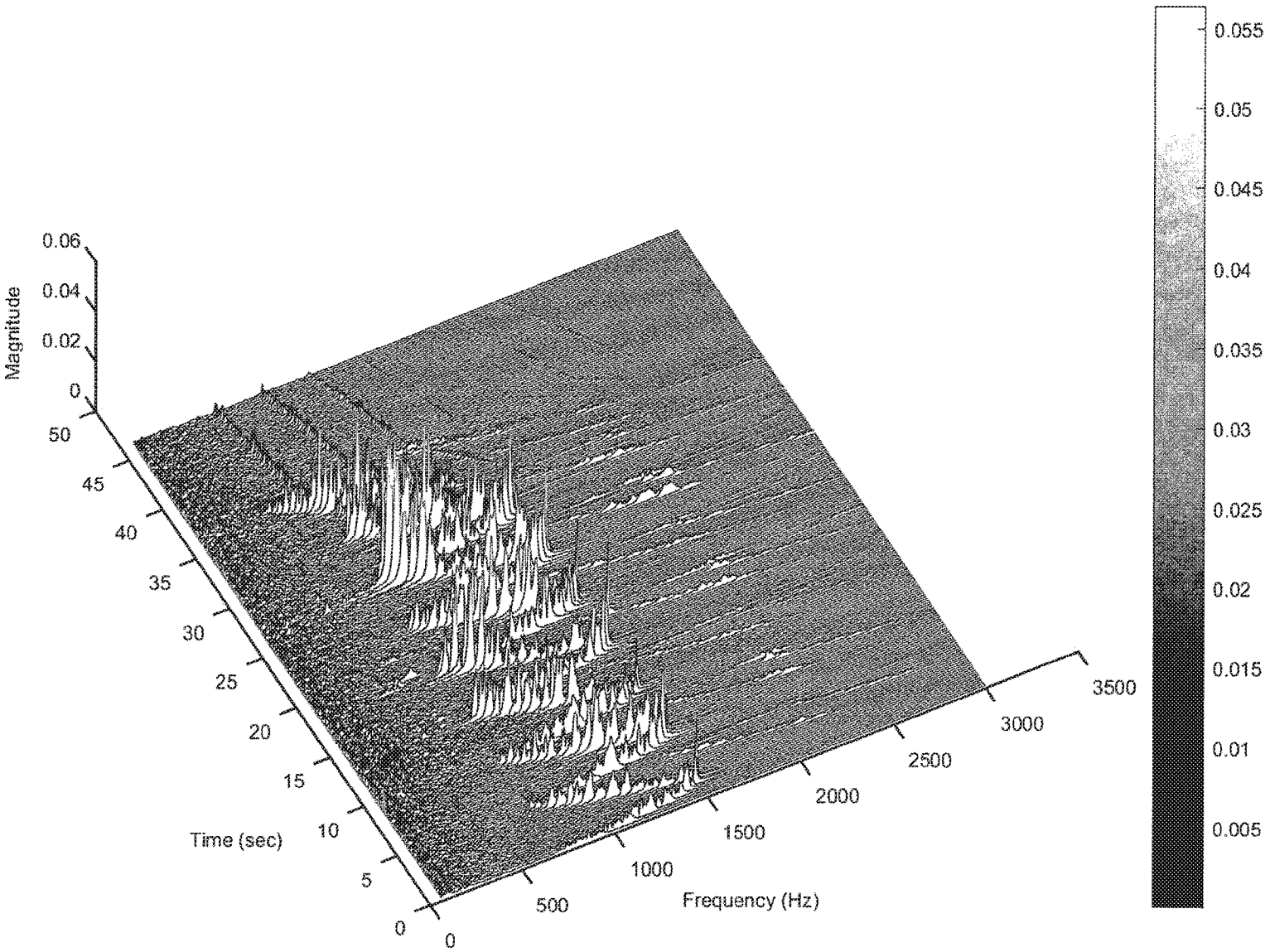
FIG. 11 provides a spectrogram of an audio recording of a New York City police-car siren in accordance with some embodiments of the invention.
Figure 12:
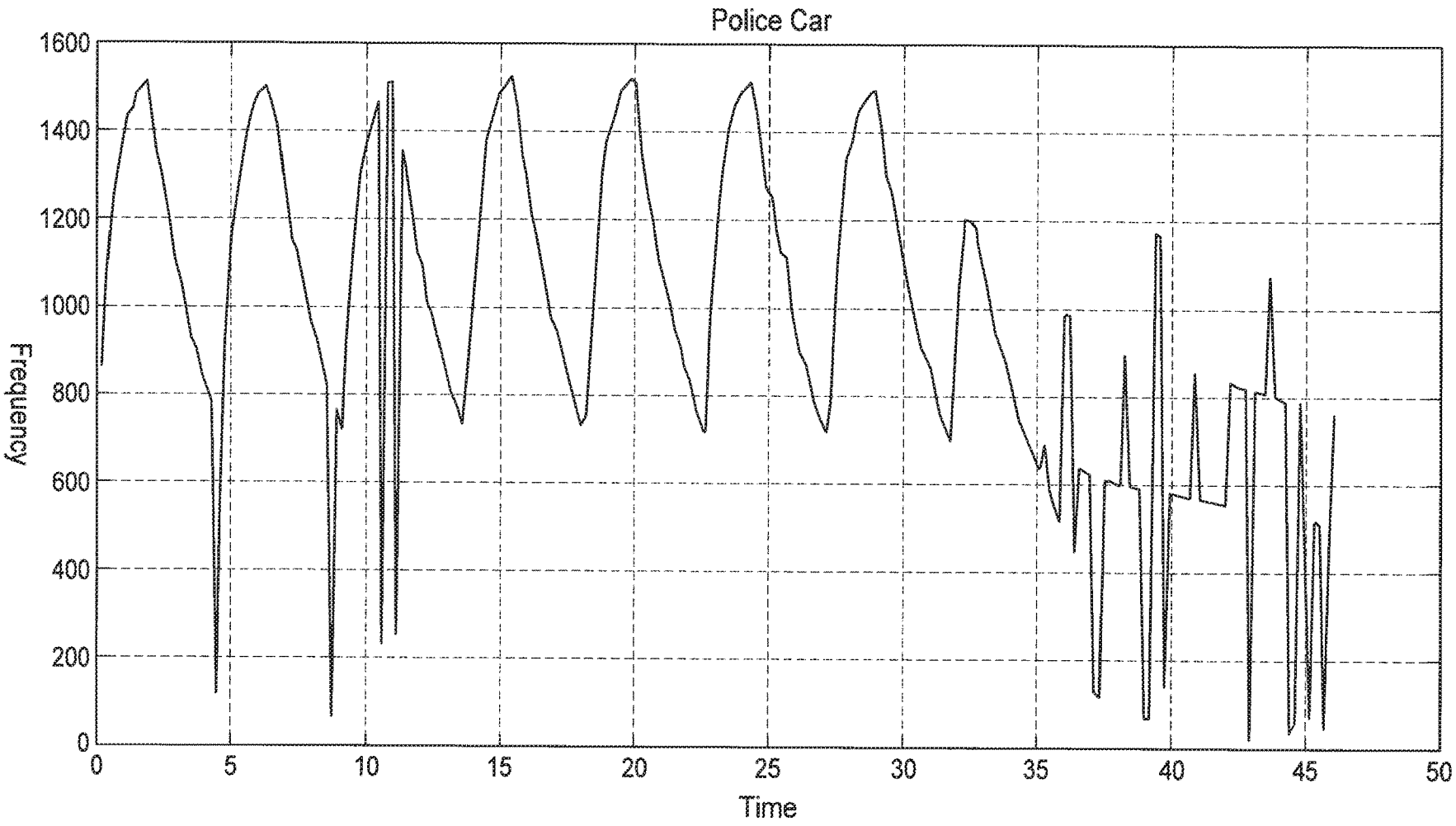
FIG. 12 provides a plot of the maximum peaks of FIG. 11 in accordance with some embodiments of the invention.

FIG. 11 depicts a spectrogram of an audio recording of a NYC police car siren taken from a NYC midtown high-rise window. The x-axis represents frequency, the y-axis represents time and the z-axis represents magnitude/loudness. The peaks of the spectrogram oscillate between approximately 600 H z and 1500 HZ, consistent with the experience of a police car siren's sinusoidal pitch. FIG. 12, which is a plot of the maximum peaks of FIG. 11, highlights this sinusoidal signal behavior. Due to the simplistic analysis of the spectrogram, specifically only extracting the absolute maximum of the stochastic signal over a fifty second recording, FIG. 12 is not exactly sinusoidal; however, the data between approximately 12 and 30 seconds shows the stable predictable nature of a police car siren. A similar exercise can be performed for other sirens, car alarms and many other unpleasant urban noises. Additionally, more exact measurements can be taken in more controlled environments to assist with the overall performance of the predictability functions of the system and thus of the system as a whole. The prediction ANC can use the knowledge of these predictable noise signals to better provide a destructive interference signal to the window transducer.

The transducer 1050, as part of the system 1000, receives the generated combined anti-noise signal, wherein the combined anti-noise signal is a weighted combination of the anti-noise signals generated by the classic ANC module 1032 and the model prediction module 1034. The transducer uses the combined anti-noise signal to generate an electronic/mechanical oscillation that will cause a window to vibrate in a pattern or generate a sound wave that will cause destructive interference of the received noise signals.

Figure 13A:
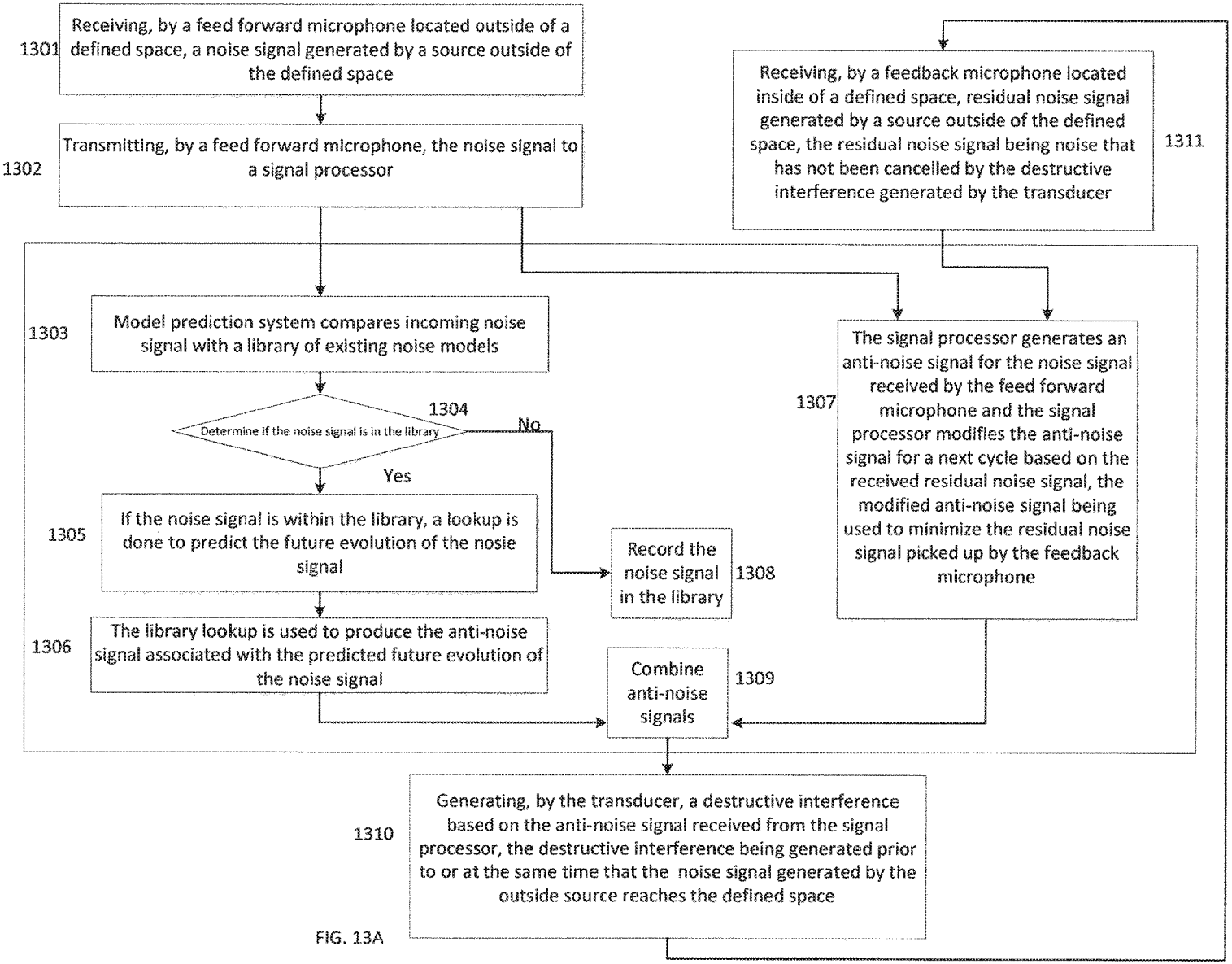
FIG. 13A illustrates a flow diagram of a predictive model-based noise cancellation system in accordance with some embodiments of the invention.

Referring now to FIG. 13A, a flow diagram illustrates a predictive model-based noise cancellation system.

In step 1301, a feed forward microphone located outside of a defined space receives or picks up noise signals generated by a source outside of the defined space.

In step 1302, the feed forward microphone transmits the noise signal to a model prediction module and a classic ANC module of a signal processor In step 1303, a model prediction module compares the received noise signal with a library of existing noise signal models or records.

In step 1304, a determination of whether the library of existing noise signal models includes the received noise signal.

If the received noise signal is found in the library of existing noise signals, then information regarding the predicted future evolution of the noise signal is extracted or retrieved from the library, in step 1305. The predicted future evolution of the noise signal includes predicted noise signals associated with the received noise signal. For example, a 50 HZ siren noise signal is received by a feed forward microphone and is transmitted to the model prediction module.

The model prediction module determines that the 50 HZ siren noise signal is stored in the library. The model prediction module looks up future predicted evolution of the 50 HZ siren noise signal. The record for the 50 HZ siren noise signal within the library indicates that a prediction that the 50 HZ siren noise signal is followed by a 40 HZ siren noise signal, then a 30 HZ siren noise signal, then a 40 HZ siren noise signal.

In step 1306, the predicted future evolution of the noise signal is used by the signal processor to generate anti-noise signals associated with the predicted future evolution of the noise signals. For example, the signal processor generates an anti-noise signal for a 40 HZ siren noise signal, then a 30 HZ siren noise signal, then a 40 HZ siren noise signal based on the received 50 HZ siren noise signal.

In step 1307, the classical ANC module generates an anti-noise signal for the noise signal transmitted to the classic ANC module in step 1302.

In step 1308, if noise signal received from the feed forward microphone is not found in the library, the signal processor records the noise signal and stores the noise signal in the library.

Once the anti-noise signal is generated, in steps 1306 and 1307, the signal processor combines the anti-noise signal associated with the noise signal transmitted by the feed forward microphone and the anti-noise signals associated with the predicted future evolution noise signals. The signal processor then sends the combined signals to a transducer, step 1309.

In step 1310, using the combined signal from the ANC module, the transducer generates a mechanical force to create surface vibrations that are used as destructing interference signals. The destructive interference signals attempt to cancel out the exterior noise signals. In one embodiment, the exterior noise signals arrive at window or exterior facing wall that mount the transducer at the same time or after the transducer begins to generate the destructive interference signals.

In step 1311, the feedback microphone located inside of a defined space receives residual noise signals generated by a source outside of the defined space. The residual noise signal is a noise signal that has not been cancelled by the destructive interference generated by the transducer.

The residual noise signal picked up by the feedback microphone is transmitted to the classic ANC module in the signal processor, in step 1307. The classic ANC module modifies or generates an anti-noise signal associated with the residual noise signal for the next cycle.

Figure 13B:
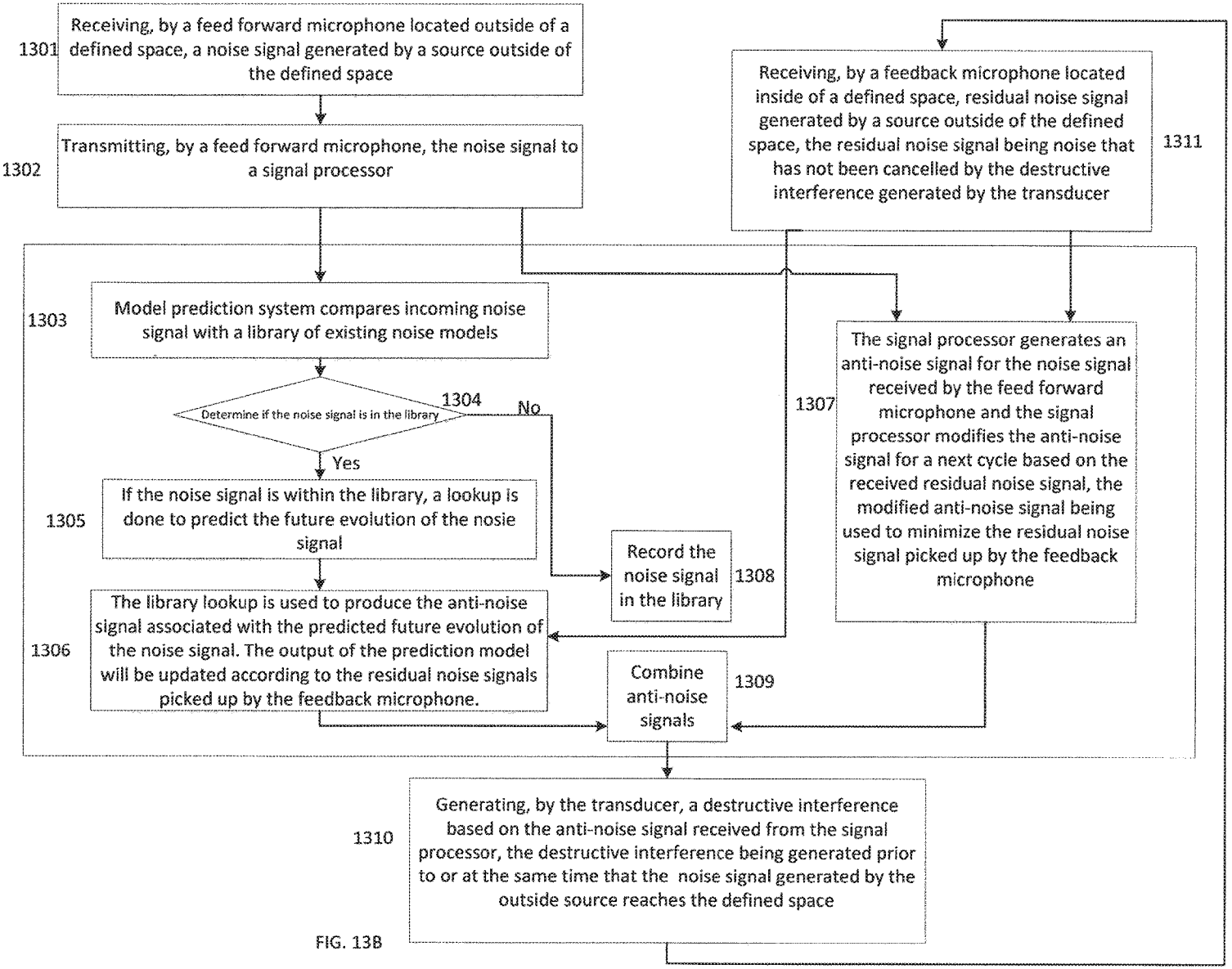
FIG. 13B illustrates a flow diagram of a predictive model-based noise cancellation system in accordance with some embodiments of the invention.

In some embodiments, as illustrated in FIG. 13B, the feedback microphone also transmits the residual noise signal picked up in step 1311 to the prediction module at step 1306, so that the library lookup is used by the prediction model to produce anti-noise signal associated with the predicted future evolution of the residual noise signal. In other words, the output of the prediction model will be updated according to the residual noise signals picked up by the feedback microphone.

Figure 14:
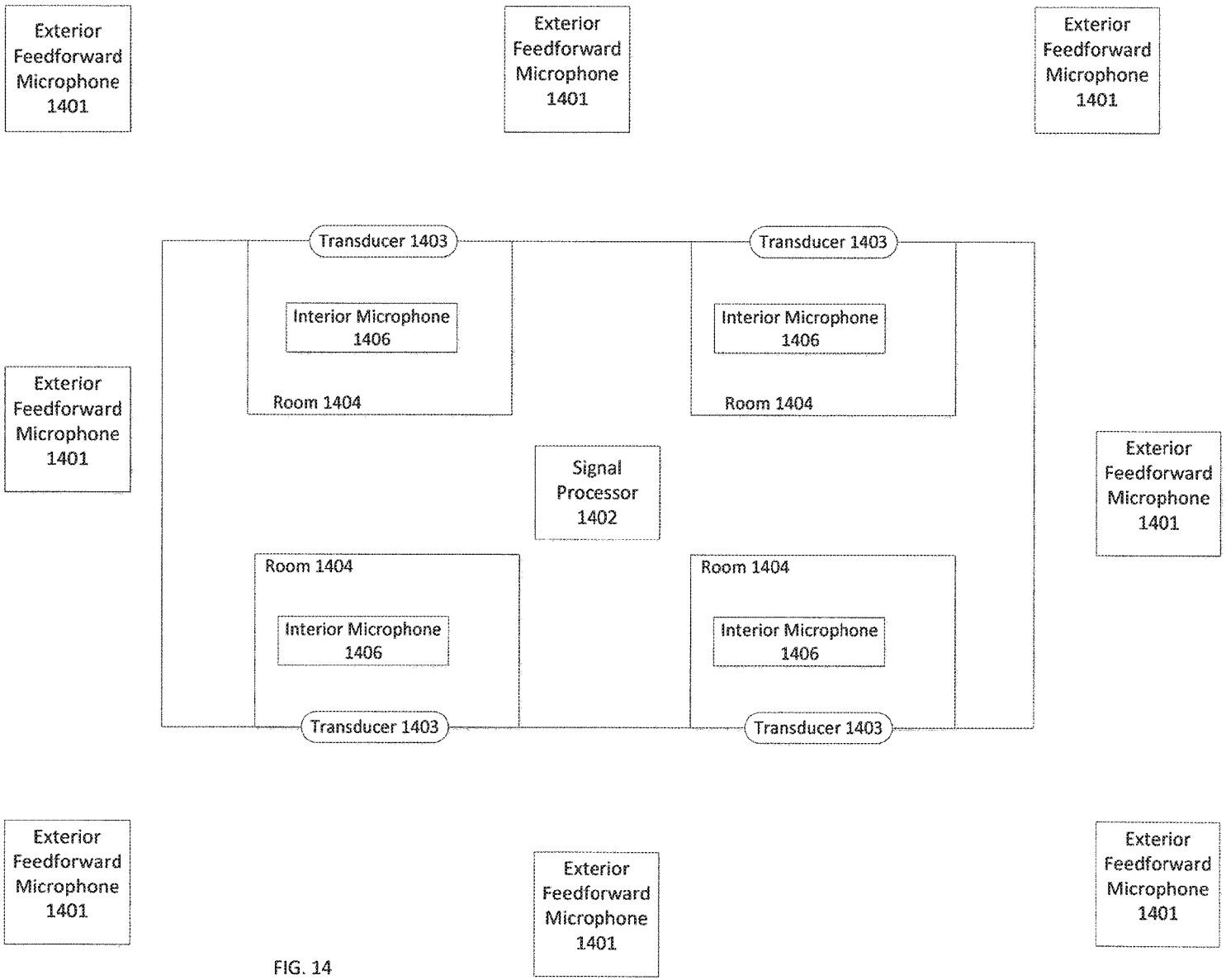
FIG. 14, illustrates a block diagram of a noise cancellation system used in a networked environment in accordance with an embodiment of the invention.

Referring now to FIG. 14, a block diagram illustrates a noise cancellation system used in a networked environment.

The noise cancellation system described above may be implemented in a networked environment, such as in a multi-roomed house or building. For example, a building in a city may have multiple apartments. Instead of each of the room or apartment individually implementing a noise cancellation system, the noise cancellation system for each apartment may be networked.

A networked noise cancelling system 1400 includes at least one exterior feed forward microphone 1401 being placed outside of a building. When the exterior feed forward microphone 1401 receives or picks up an outside noise signal, the outside noise signal is forwarded to a centralized signal processor 1402. Upon receiving the noise signal from the exterior feed forward microphone, the centralized signal processor 1402 generates an anti-noise signal and transmits the anti-noise signal to a plurality of transducers 1403. Each apartment or room 1404 within the building 1405 has at least one of the pluralities of transducers 1403. When each of the transducers 1403 receives the amplified inverses signal from the centralized signal processor 1402, the transducers 1403 generates a destructive interference as disclosed above.

Interior feedback microphones 1406 for each apartment or room 1404 in the building 1405 may receive or pickup up noise signals within their respective apartment or room 1404. The noise signals that are picked up by the interior feedback microphones 1406 are forwarded to the centralized signal processor 1402 and the centralized signal processor 1402 modifies the amplified inversed signal and transmits the amplified inversed signal to the transducers 1401. In one embodiment, the centralized signal processor 1402 may compare the noise from received from the interior feedback microphones 1406 to determine if the noise correlates to the outside noise signal picked up by the exterior feed forward microphone. If the noise correlates to the outside noise signal, the centralized signal processor 1402 modifies the amplified inversed signal and sends the modified amplified inversed signal to the transducers 1403. In this way, one user's internal microphone is another user's external microphone.

In one embodiment, the networked noise cancelling system 1400 includes a plurality of exterior feed forward microphones 1401. Each of the plurality of exterior feed forward microphones 1401 will pick up or receive noise signals from outside noise signals. The exterior feed forward microphones 1401 will forward the noise signals to the centralized signal processor 1402 along with location information associated with the exterior feed forward microphone. The centralized signal processor 1402 may generate anti-noise signala associated with the noise signals and transmit the anti-noise signals to transducers near specific exterior feed forward microphones 1401 based on the location information. For example, exterior feed forward microphones 1401 near the north side of a building may pick up noise signals from an engine hum, while exterior feed forward microphones 1401 near the south side of a building pick up noise signals from a music playing in the street, but not the noise signals of the engine hum. When the centralized signal processor 1402 receives the noise signals of the engine hum and the location information of the exterior feed forward microphones 1401 facing the north side of the building, the centralized signal processor may generate anti-noise signals for the engine hum and transmit them to transducers 1403 located near and/or associated with the north side building. Similarly, the centralized signal processor 1402 will generate different anti-noise signals for the music playing on the street and transmit the anti-noise signal associated with the music to transducers 1403 located near and/or associated with the south side of the building.

Figure 15:
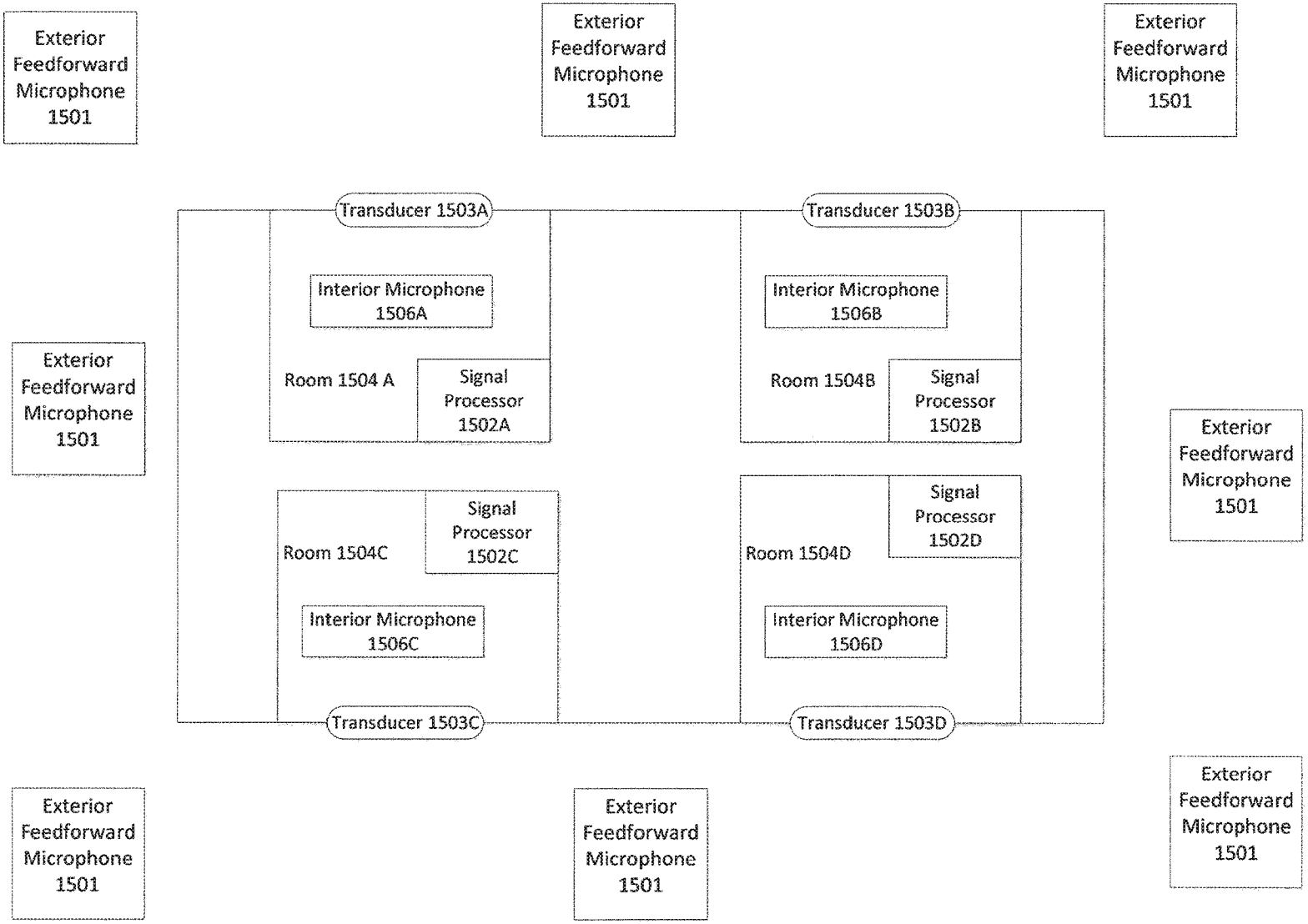
FIG. 15 illustrates a block diagram of a noise cancellation system used in a networked environment in accordance with another embodiment of the invention.

In another embodiment, the networked noise cancelling system comprises a plurality of rooms 1504A-1504D, wherein each room has a signal processor 1502A-1502D, as illustrated in FIG. 15. Each signal processor for each room receives noise signals from at least one of the plurality exterior feed forward microphones 1501. Furthermore, each of the signal processors 1502A-1502D may be communicatively coupled so that information pertaining to the noise signals may be transmitted amongst the signal processors 1502A-1502D.

Figure 16:
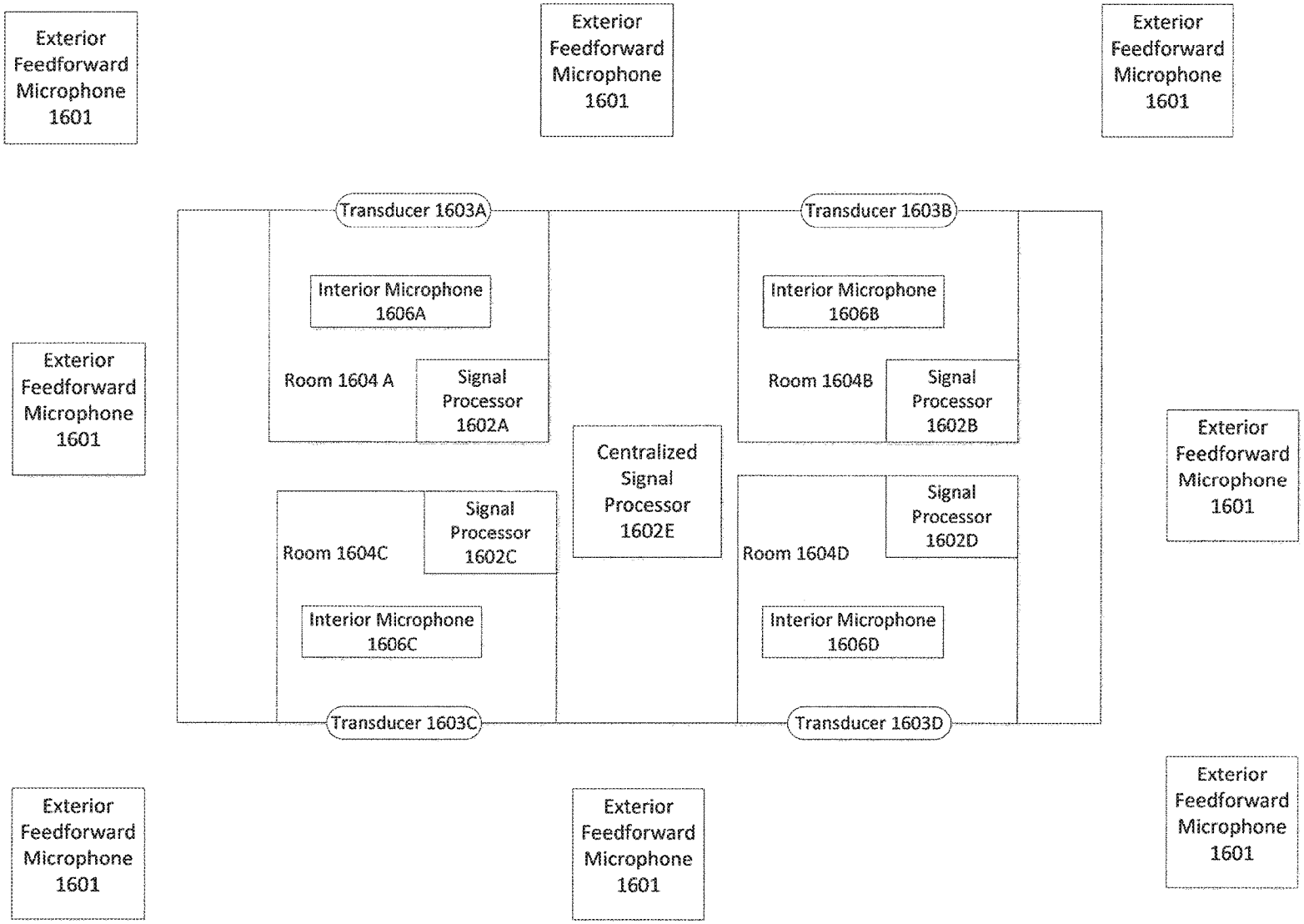
FIG. 16 illustrates a block diagram of a noise cancellation system used in a networked environment in accordance with another embodiment of the invention.

In another embodiment, the networked noise cancelling system comprises both a centralized signal processor 1602E and a set of signal processors located in each room 1602A-1602D, as illustrated in FIG. 16. The central signal processor 1602E and the set of signal processors located in each room 1602A-1602D are communicatively coupled so that information pertaining to the noise signals may be transmitted amongst the signal processors 1602A-1602D.

Figure 17:
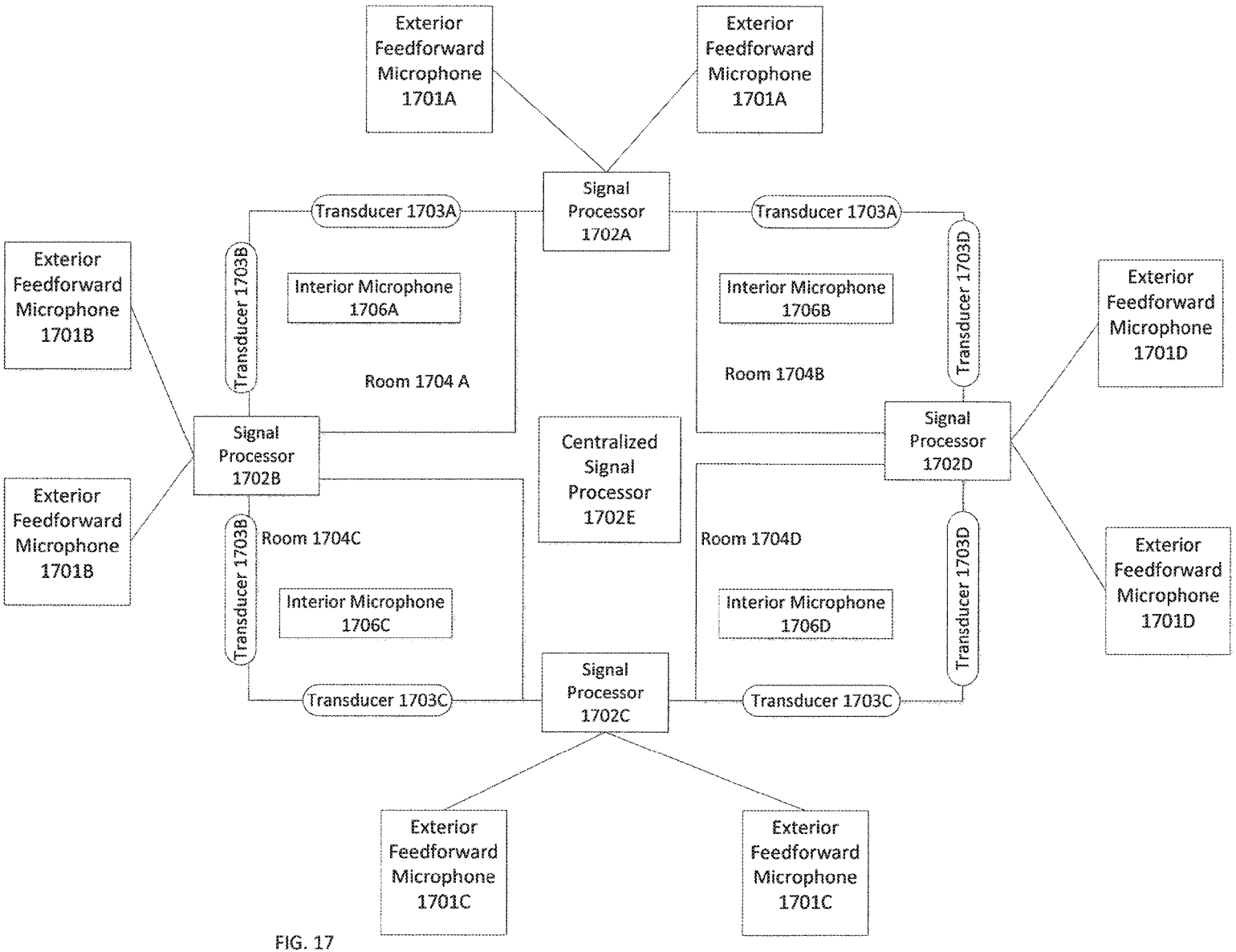
FIG. 17 illustrates a block diagram of a noise cancellation system used in a networked environment in accordance with some embodiments of the invention.

In another embodiment, a building may have a plurality of centralized servers for a specified set of transducers, as illustrated in FIG. 17. In FIG. 17, the networked noise cancelling system includes different sets of exterior feed forward microphones. For example, exterior feed forward microphones 1701A, 1701B, 1701C and 1701D are separate sets of exterior feed forward microphones. A set, as used herewith, includes one or more device. Each set of exterior feed forward microphones is associated with a signal processor. For example, the set of exterior feed forward microphones 1701A is associated with signal processor 1702A. Within the building, multiple signal processors may be used, such as 1702A, 1702B, 1702C and 1702D. Each signal processor is associated with at least one set of exterior feed forward microphones 1701A, 1701B, 1701C and 1701D.

Each signal processor within the building is associated with a set of transducers. For example, signal processor 1702A is associated with the set of transducers 1703A. When the signal processor receives a noise signal from an exterior microphone that is associated with the signal process, the signal processor generates an anti-noise signal to transmit to the set of transducers associated with the signal processor and each of the transducer in the set of transducers generates a destructive interference.

In one embodiment, each room within the building may include multiple transducers that are associated with different signal processors. For example, transducer 1703A is associated with signal processor 1702A and transducer 1703B, located in the same room 1704 as transducer 1703A, is associated with signal processor 1702B. When an interior feedback microphone for room 1704 receives residual noise signals that originated from the outside noise signal, the interior feedback microphone will send the residual noise signal to the both signal processors 1702A and 1702B. The signal processors 1702A and 1702B will adjust, modify, and/or generate an anti-noise signal to transmit to both 1703A and 1703B, respectively. In one embodiment, the signal processor will only transmit the anti-noise signal to transducers within the room that is associated with interior feedback microphone that sent the residual noise signal. For example, signal processor 1702A will only transmit the modified anti-noise signal to transducer 1703A because the interior feedback microphone within room 1704 had sent the residual noise signal.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The invention claimed is:

1. An active noise cancellation (ANC) system comprising:

a plurality of microphones;

a transducer attached to a surface in a room;

one or more processors;

data storage accessible to the one or more processors; and a non-transitory computer readable medium storing a plurality of instructions, which when executed, cause the one or more processors to:

receive a plurality of audio signals generated in an exterior environment of a room from the plurality of microphones;

determine that at least one of the plurality of received audio signals is the same as a stored audio signal in an audio signal library stored in the data storage, the audio signal library storing a plurality of stored audio signals and a predicted future evolution model for each of the plurality of stored audio signals;

generate at least one anti-noise signal corresponding to the stored audio signal and to the predicted future evolution model associated with the stored audio signal based on the determination that the at least one of the plurality of received audio signals is the same as the stored audio signal; and transmit the at least one anti-noise audio signal to the transducer;

convert the transmitted anti-noise signal into a destructive interference audio signal propagated by the surface in the room;

in response to the determination that the at least one of the plurality of received audio signals is not stored in the audio signal library:

record the received audio signal, determine a confidence metric of the received audio signal, determine a predicted future evolution model associated with the received audio signal based on the determined confidence metric of the received audio signal;

store the recorded received audio signal and the determined predicted future evolution model associated with the received audio signal in the audio signal library; and modify the confidence metric of the at least one of the plurality of received audio signals based on a number of times the received audio signals is observed within a period of time.

2. The ANC system of claim 1, further comprising instructions, which when executed, cause the one or more processors to:

generate a first anti-noise signal to counteract at least one of the received audio signals;

receive the predicted future evolution model associated with the at least one received audio signal from the audio signal library;

generate a second anti-noise signal, the second anti-noise signal counteracting the retrieved predicted future evolution model of the at least one received audio signal;

combine the first anti-noise signal and the second anti-noise signal into a combined anti-noise signal.

3. The ANC system of claim 1, further comprising instructions, which when executed, cause the one or more processors to:

receive, via a feedback microphone located in an inside environment of the room, residual noise signal generated in the exterior environment of the room;

generate a third anti-noise signal, the third anti-noise signal counteracting the residual noise signal received by the feedback microphone; and modify the combined anti-noise signal based on the third anti-noise signal.

4. The ANC system of claim 1, comprising instructions, which when executed, cause the one or more processors to:

modify the predicted future evolution model associated with the at least one of the plurality of received audio signals based on the modified confidence metric.

5. An active noise cancellation (ANC) system comprising:

a plurality of microphones;

a transducer attached to a surface in a room;

one or more processors;

data storage accessible to the one or more processors; and a non-transitory computer readable medium storing a plurality of instructions, which when executed, cause the one or more processors to:

receive a plurality of audio signals generated in an exterior environment of a room from the plurality of microphones;

determine that at least one of the plurality of received audio signals is the same as a stored audio signal in an audio signal library stored in the data storage, the audio signal library storing a plurality of stored audio signals and a predicted future evolution model for each of the plurality of stored audio signals;

generate at least one anti-noise signal corresponding to the stored audio signal and to the predicted future evolution model associated with the stored audio signal based on the determination that the at least one of the plurality of received audio signals is the same as the stored audio signal; and transmit at least one anti-noise audio signal to the transducer;

convert the transmitted anti-noise signal into a destructive interference audio signal propagated by the surface in the room; and input the at least one of the plurality of received audio signals into a linear quadratic estimation (LQE) filter, the LQE filter being configured to receive the received audio signal as input and being configured to receive the predicted future evolution model of the received audio signal as input.

6. An active noise cancellation (ANC) method, the method comprising:

receiving a plurality of audio signals generated in an exterior environment of a room from the plurality of microphones;

determining that at least one of the plurality of received audio signals is the same as a stored audio signal in an audio signal library stored in the data storage, the audio signal library storing a plurality of stored audio signals and a predicted future evolution model for each of the plurality of stored audio signals;

generating at least one anti-noise signal corresponding to the stored audio signal and to the predicted future evolution model associated with the stored audio signal based on the determination that the at least one of the plurality of received audio signals is the same as the stored audio signal; and transmitting at least one anti-noise audio signal to a transducer attached to a surface in a room; and converting the transmitted anti-noise signal into a destructive interference audio signal propagated by the surface in the room;

in response to the determination that the received audio signal is not stored in the audio signal library:

recording the received audio signal, determining a confidence metric of the received audio signal, determining a predicted future evolution model associated with the received audio signal based on the determined confidence metric of the received audio signal;

storing the recorded received audio signal and the determined predicted future evolution model associated with the received audio signal in the audio signal library;

wherein the confidence metric of the received audio signal is modified based on a number of times the received audio signal is observed within a period of time.

7. The ANC method of claim 6, wherein generating the anti-noise signals comprises: generating a first anti-noise signal to counteract at least one of the received audio signals;

receiving the predicted future evolution model associated with the at least one received audio signal from the audio signal library;

generating a second anti-noise signal, the second anti-noise signal counteracting the retrieved predicted future evolution model of the at least one received audio signal;

combining the first anti-noise signal and the second anti-noise signal into a combined anti-noise signal.

8. The ANC method of claim 6, further comprising:

receiving, via a feedback microphone located in an inside environment of the room, residual noise signal generated in the exterior environment of the room;

generating a third anti-noise signal, the third anti-noise signal counteracting the residual noise signal received by the feedback microphone; and modifying the combined anti-noise signal based on the third anti-noise signal.

9. The ANC method of claim 6, further comprising:

modifying the predicted future evolution model associated with the at least one of the plurality of received audio signals based on the modified confidence metric.

* * * * *